US009465335B2

(12) United States Patent
Sato

(10) Patent No.: US 9,465,335 B2
(45) Date of Patent: Oct. 11, 2016

(54) IMAGE FORMATION APPARATUS

(71) Applicant: Oki Data Corporation, Tokyo (JP)

(72) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/692,782

(22) Filed: Apr. 22, 2015

(65) Prior Publication Data

US 2015/0309456 A1 Oct. 29, 2015

(30) Foreign Application Priority Data

Apr. 23, 2014 (JP) ..... 2014-089125

(51) Int. Cl.
*G03G 15/20* (2006.01)

(52) U.S. Cl.
CPC ..... *G03G 15/2039* (2013.01); *G03G 15/205* (2013.01); *G03G 15/2042* (2013.01); *G03G 15/2046* (2013.01); *G03G 15/2082* (2013.01); *G03G 2215/00734* (2013.01)

(58) Field of Classification Search
CPC ..... G03G 2215/00734; G03G 15/2039; G03G 15/2046; G03G 15/205
USPC ..... 399/69
See application file for complete search history.

(56) References Cited

U.S. PATENT DOCUMENTS 5,682,577 A * 10/1997 Kiyoi ..... G03G 15/2039 219/494
8,731,429 B2 * 5/2014 Asami ..... G03G 15/2042 399/329
2008/0240748 A1 * 10/2008 Kinouchi ..... G03G 15/2039 399/33
2012/0051766 A1 * 3/2012 Ueno ..... G03G 15/205 399/45
2013/0136479 A1 * 5/2013 Yuasa ..... G03G 15/2046 399/69
2014/0294418 A1 * 10/2014 Sato ..... G03G 15/2042 399/69

FOREIGN PATENT DOCUMENTS

JP 2008-249763 A 10/2008
JP 2008249763 A * 10/2008
JP 2014-194443 A 10/2014

* cited by examiner

*Primary Examiner* — David Gray
*Assistant Examiner* — Tyler Hardman
(74) *Attorney, Agent, or Firm* — Mots Law, PLLC

(57) ABSTRACT

An image formation apparatus includes a fixation unit supported by a support member and configured to be heated by a heater and thereby fix an image attached on a print medium onto the print medium; a first temperature detector attached to the support member to detect a temperature of a vicinity of the fixation unit and output a first detection temperature; a second temperature detector attached to the support member to detect a temperature of the support member and output a second detection temperature; a medium width detector provided to detect a width of the print medium and output a detected width; and a heat controller configured to change a control condition in accordance with the second detection temperature, a calorific value of the heater and the detected width, and to thereby control a temperature of the fixation unit.

22 Claims, 14 Drawing Sheets

IMAGE FORMATION APPARATUS OF EMBODIMENT 1

TEMPERATURE CONTROL AND TEMPERATURE CHANGES ON FIXATION UNIT OF COMPARATIVE EXAMPLE

CASE OF PRINTING ON LETTER-SIZE SHEETS

TEMPERATURE CONTROL AND TEMPERATURE CHANGES ON FIXATION UNIT OF COMPARATIVE EXAMPLE

CASE OF PRINTING ON A4-SIZE SHEETS

CHARACTERISTICS OF FIXATION UNIT ILLUSTRATED IN FIGS. 5A AND 5B

INPUT HEAT QUANTITY AS WELL AS TEMPERATURE DIFFERENCE BETWEEN MIDDLE PORTION AND END PORTIONS

CHARACTERISTICS OF FIXATION UNIT ILLUSTRATED IN FIGS. 5A AND 5B

SHEET WIDTH AND INPUT HEAT QUANTITY MAKING TEMPERATURES OF END PORTIONS LESS THAN TEMPERATURE OF MIDDLE PORTION BY 15 °C

PROCESSES FOR TEMPERATURE CONTROL ON FIXATION UNIT OF EMBODIMENT 1

TEMPERATURE CONTROL AND TEMPERATURE CHANGES ON FIXATION UNIT OF EMBODIMENT 1

CASE OF PRINTING ON LETTER-SIZE SHEETS

TEMPERATURE CONTROL AND TEMPERATURE CHANGES ON FIXATION UNIT OF EMBODIMENT 1

CASE OF PRINTING ON A4-SIZE SHEETS

CHARACTERISTICS OF FIXATION UNIT OF EMBODIMENT 2

NUMBER OF PRINTED PRINT MEDIA AS WELL AS TEMPERATUER DIFFERENCE BETWEEN MIDDLE PORTION AND END PORTIONS

CHARACTERISTICS OF FIXATION UNIT OF EMBODIMENT 2

SHEET WIDTH AND NUMBER OF PRINTED PRINT MEDIA MAKING TEMPERATURES OF END PORTIONS LESS THAN TEMPERATURE OF MIDDLE PORTION BY 15 °C

PROCESSES FOR TEMPERATURE CONTROL ON FIXATION UNIT OF EMBODIMENT 2

TEMPERATURE CONTROL AND TEMPERATURE CHANGES ON FIXATION UNIT OF EMBODIMENT 2

CASE OF PRINTING ON LETTER-SIZE SHEETS

TEMPERATURE CONTROL AND TEMPERATURE CHANGES ON FIXATION UNIT OF EMBODIMENT 2

CASE OF PRINTING ON A4-SIZE SHEETS

BELT-TYPE FIXATION UNIT

IMAGE FORMATION APPARATUS

CROSS REFERENCE TO RELATED APPLICATIONS

This application claims priority based on 35 USC 119 from prior Japanese Patent Application No. 2014-089125 filed on Apr. 23, 2014, entitled "IMAGE FORMATION APPARATUS", the entire contents of which are incorporated herein by reference.

BACKGROUND OF THE INVENTION

1. Field of the Invention

This disclosure relates to an image formation apparatus including a fixation unit.

2. Description of Related Art

An electrophotographic printer as one of image formation apparatuses transfers toner as a developer corresponding to a print image onto a sheet as a print medium, and fixes a toner image as the transferred developer image onto the sheet with heat and pressure of a fixation unit. In a conventional electrophotographic printer described in Japanese Patent Application Publication No. 2008-249763, a fixation unit includes a fixation roller and a pressure roller; and temperature detectors and fixation heaters for heating the fixation roller are disposed at their respective positions which are different from one another in the longitudinal direction. In addition, the fixation heaters are controlled independently of one another based on results of the detection of temperatures by the temperature detectors. This makes it possible to stabilize the temperature of the fixation unit in the longitudinal direction.

SUMMARY OF THE INVENTION

The conventional image formation apparatus, nevertheless, has problems (a) and (b) as follows.

(a) When the image formation apparatus starts printing while the temperature of the fixation unit is low at room temperature, a heat shortage occurs in the end portions of the fixation unit which are close to a support member for supporting the fixation unit because the temperature of the support member is low and the heat capacity of the support member is large. This causes a fixation failure.

(b) A control method of setting the temperature of the fixation unit at a higher temperature in advance is available as the measure to counter the problem (a). However, the image formation apparatus adopting such a control method consumes a larger amount of electric power.

A first aspect of the invention is an image formation apparatus that includes: a heater; a fixation unit supported by a support member, and configured to be heated by the heater and thereby fix an image attached on a print medium onto the print medium; a first temperature detector attached to the support member, and configured to detect a temperature in the vicinity of the fixation unit and output a first detection temperature; a second temperature detector attached to the support member, and configured to detect a temperature of the support member and output a second detection temperature; a medium width detector provided to detect the width of the print medium and output a detected width; and a heat controller configured to change a control condition in accordance with the second detection temperature, a calorific value of the heater and the detected width, and control a temperature of the fixation unit.

A second aspect of the invention is an image formation apparatus that includes: a heater; a fixation unit provided to be heated by the heater and thereby fix an image attached on a print medium onto the print medium; a first temperature detector provided to detect a temperature of the vicinity of the fixation unit and output a first detection temperature; a second temperature detector provided to detect a temperature of a place which is different from that of the first temperature detector, and output a second detection temperature; a medium width detector provided to detect the width of the print medium and output a detected width; and a heat controller configured to control a temperature of the fixation unit based on the first detection temperature and a target temperature. Under a predetermined condition, the heat controller controls the temperature of the fixation unit by setting the target temperature at a first target temperature. If a quantity of heat supplied to the fixation unit exceeds a value for a heat quantity judgment set based on the detected width while controlling the drive of the heater based on the first target temperature and the first detection temperature, the heat controller replaces the first target temperature with a second target temperature which is lower than the first target temperature, and continues fixing the image onto the print medium.

A third aspect of the invention is an image formation apparatus that includes: a heater; a fixation unit provided to be heated by the heater and thereby fix an image attached on a print medium onto the print medium; a first temperature detector provided to detect a temperature of the vicinity of the fixation unit and output a first detection temperature; a second temperature detector provided to detect a temperature of a place which is different from that of the first temperature detector, and output a second detection temperature; a medium width detector provided to detect the width of the print medium and output a detected width; a number-of-printed-print-media detector provided to detect the number of printed print media that have been printed continuously since starting the printing, and output a detected number of printed print media; and a heat controller configured to control a temperature of the fixation unit based on the first detection temperature and a target temperature. Under a predetermined condition, the heat controller controls the temperature of the fixation unit by setting the target temperature at a first target temperature. If the detected number of printed print media exceeds the number of print media for a heat quantity judgment set based on the detected width while controlling the drive of the heater based on the first target temperature and the first detection temperature, the heat controller replaces the first target temperature with a second target temperature which is lower than the first target temperature, and continues fixing the image onto the print medium.

According to the foregoing aspects, the medium width detector detects the width of the print medium, and the heater controller changes the control condition (for instance, the target temperature of the fixation unit) in accordance with the detected width. For this reason, when the image formation apparatus makes the printing on the print medium (for instance, an A4-size sheet) which is narrower than the maximum printable width, the heat controller is capable of giving the fixation unit a minimum necessary heat quantity which does not allow the occurrence of the fixing failure, by changing (lowering, for instance) the target temperature at a time when the quantity of heat inputted into the fixation unit reaches a lower input heat quantity. For this reason, the heat controller is capable of preventing the occurrence of the fixing failure and reducing the power consumption.

BRIEF DESCRIPTION OF THE DRAWINGS

FIG. 5C is a diagram of the distribution of calorific values of the fixation heater illustrated in FIG. 5A.

DETAILED DESCRIPTION OF EMBODIMENTS

Figure 1:
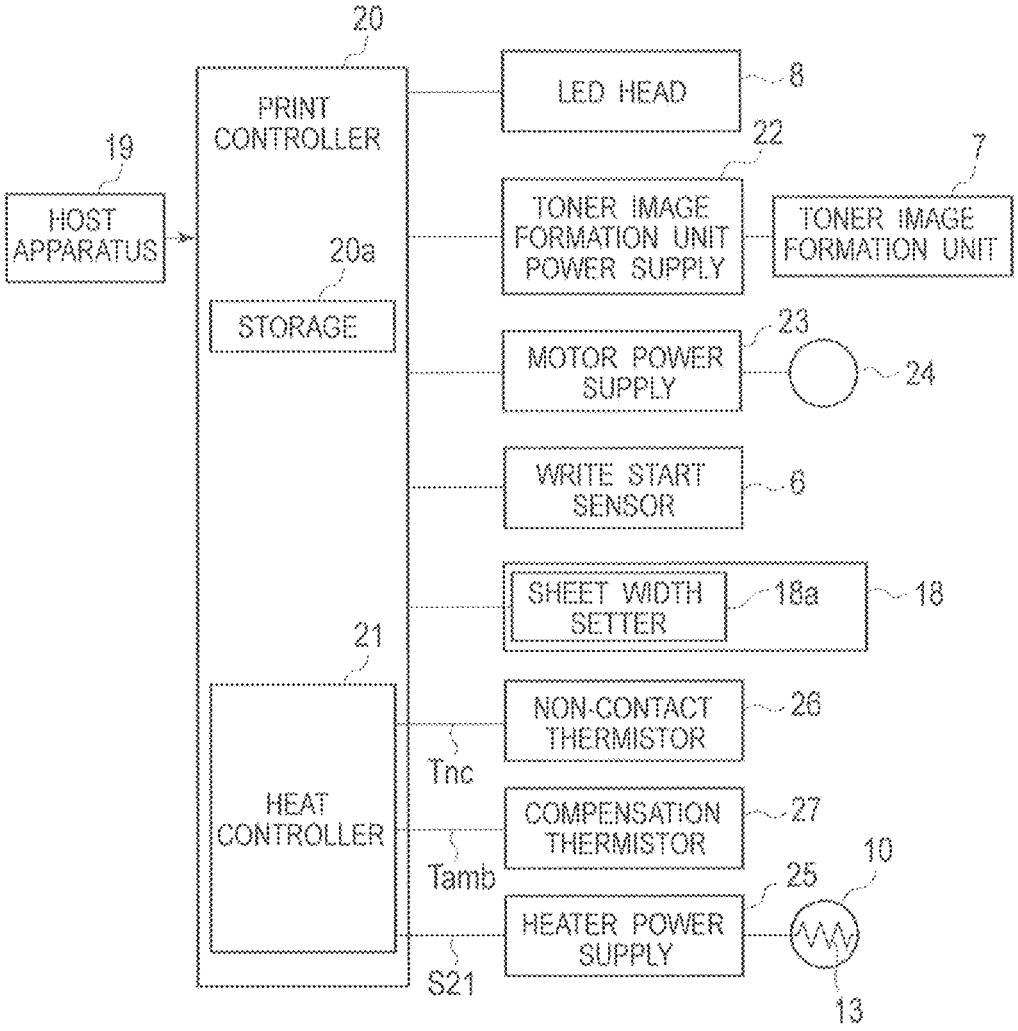
FIG. 1 is a schematic configuration block diagram illustrating a control unit in an image formation apparatus illustrated in FIG. 2.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

[Embodiment 1]

Embodiments for carrying out the invention become apparent from reading the following descriptions for preferred examples while referring to the accompanying drawings. It should be noted that the drawings are provided mainly for the purpose of making the descriptions easy to understand, and do not limit the scope of the invention.

(Configuration of Embodiment 1)

Figure 2:
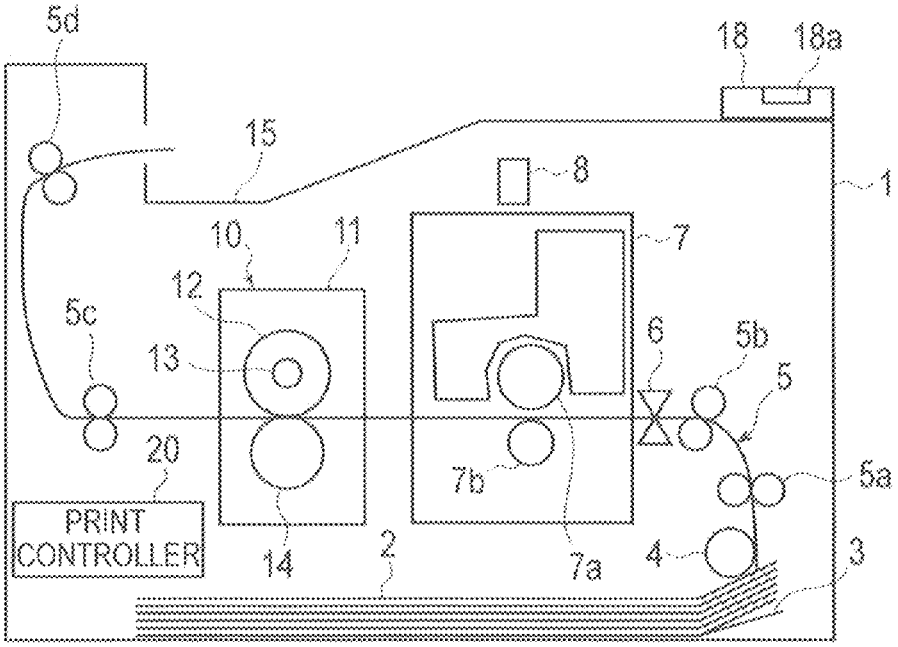
FIG. 2 is a schematic configuration diagram illustrating the image formation apparatus of Example 1 of the invention.

FIG. 2 is a schematic configuration diagram illustrating an image formation apparatus of Embodiment 1 of the invention.

This image formation apparatus is, for instance, an electrophotographic printer, and includes housing 1. Sheet cassette 3 for containing sheets 2 as print media is detachably installed in a lower portion of housing 1. Hopping roller 4 for feeding sheets 2 on a one-by-one basis is disposed above a front end of sheet cassette 3. Sheet 2 fed by hopping roller 4 is transported along sheet transport passage 5 to an upper portion of housing 1. Sheet transport passage 5 is provided with transport rollers 5*a*, 5*b*, 5*c*, 5*d* for transporting sheet 2 downstream.

Toner image formation unit 7 for forming a toner image as a developer image is disposed downstream of transport roller 5*b* with write start sensor 6 as a number-of-printed-print-media detector interposed in between. Write start sensor 6 is a sensor for detecting where a sheet, before the image formation, is being transported in sheet transport passage 5. Light emitting diode (hereinafter referred to as an "LED") head 8 as a record light exposure member for emitting a record light is disposed above and adjacent to toner image formation unit 7. Toner image formation unit 7 forms a toner image on sheet 2 in accordance with the record light emitted from LED head 8. Toner image formation unit 7 includes, among other things, photosensitive drum 7*a* as an electrostatic latent image carrier, and transfer roller 7*b* as a transfer device for transferring a toner image formed on photosensitive drum 7*a* onto sheet 2.

Roller-type fixation unit 10, for instance, is disposed downstream of toner image formation unit 7. Fixation unit 10 fixes the toner image on sheet 2 to sheet 2 with heat and pressure, and includes support member 11 as a chassis, for instance. Support member 11 supports fixation roller 12 as a fixation device, and pressure roller 14 as a pressure member. Fixation roller 12 houses fixation heater 13 as a heater for heating fixation roller 12 by supplying heat to fixation roller 12. Transport rollers 5*c*, 5*d* deliver sheet 2, to which fixation unit 10 fixes the toner image, to stacker 15 outside of housing 1.

Outside housing 1, operation panel 18 is provided at a position (on an upper portion of housing 1, for instance) which enables a user to manipulate operation panel 18. The user carries out various settings (setting of the thickness and the like of sheets 2, for instance) with operation panel 18. As a part of its functions, operation panel 18 includes sheet width setter 18*a* as a medium width detector. By manipulating sheet width setter 18*a*, the user can set the width of sheets 2 which are set in the image formation apparatus. For instance, when letter-size sheets (215.9 mm wide and 279.4 mm long), A4-size sheets (210 mm wide and 297 mm long) and the like are prepared in advance, the user can select one from the letter size, the A4 size and the like using sheet width setter 18*a*. In addition, print controller 20 for controlling the overall print operation and for functioning as a heat controller is provided inside housing 1.

It should be noted that although the image formation apparatus of Embodiment 1 is designed such that operation panel 18 is provided with sheet width setter 18*a* and the user sets a sheet width using sheet width setter 18*a*, the image formation apparatus may be designed such that: sheet cassette 3 is provided with a sheet size detection mechanism and a sensor; and the sheet size detection mechanism and the sensor automatically detect a sheet size. Otherwise, the image formation apparatus may be designed such that: a print driver is installed in a host apparatus such as a personal computer; and the user selects a sheet width and a sheet size using the print driver.

FIG. 1 is a schematic configuration block diagram illustrating the control unit in the image formation apparatus illustrated in FIG. 2. The control unit includes print controller 20 which receives instructions from host apparatus 19 such as a personal computer. Following instructions and the like from host apparatus 19, print controller 20 controls print operations of the image formation apparatus. Print controller 20 includes, among other things, storage 20*a* for storing print temperature Tprn and the like, and heat controller 21 for controlling the heated condition of fixation unit 10. Print controller 20 comprises a central processing unit (CPU) and/or the like.

Write start sensor 6, LED head 8, and operation panel 18 including sheet width setter 18*a* are connected to print controller 20. Further, connected to print controller 20 are toner image formation unit power supply 22 for applying voltage to toner image formation unit 7; motor power supply 23 for supplying electric power to sheet transport motor 24 configured to drive transport rollers 5*a* to 5*d* and the like; heater power supply 25 for supplying electric power to fixation heater 13; non-contact thermistor 26 as a first temperature detector for detecting a temperature of the vicinity of fixation roller 12 and outputting first detection temperature Tnc; and compensation thermistor 27 as a second temperature detector for detecting a temperature of support member 11 to which non-contact thermistor 26 is attached, and outputting compensation temperature Tamb as a second detection temperature.

Heat controller 21 in print controller 20 performs on and off controls on heater power supply 25 by outputting control signal S21 on the basis of detection temperature Tnc, detected by non-contact thermistor 26, and compensation temperature Tamb, detected by compensation thermistor 27, for the purpose of controlling the heating of fixation roller 12 up to a set temperature. Non-contact thermistor 26 and compensation thermistor 27 are unitized as a single temperature detector, and attached to support member 11 for supporting fixation roller and pressure roller 14. Support member 11 supports non-contact thermistor 26 and fixation roller 12 with a certain clearance between non-contact thermistor 26 and fixation roller 12. Compensation thermistor 27 performs a function of detecting an amount of heat transfer from non-contact thermistor 26 to support member 11 in the form of a temperature by detecting the temperature of support member 11 to which non-contact thermistor 26 is attached. Heat controller 21 performs a function of detecting the surface temperature of fixation roller 12 without contact from detection temperature Inc from non-contact thermistor 26 and compensation temperature Tamb from compensation thermistor 27.

Figure 3:
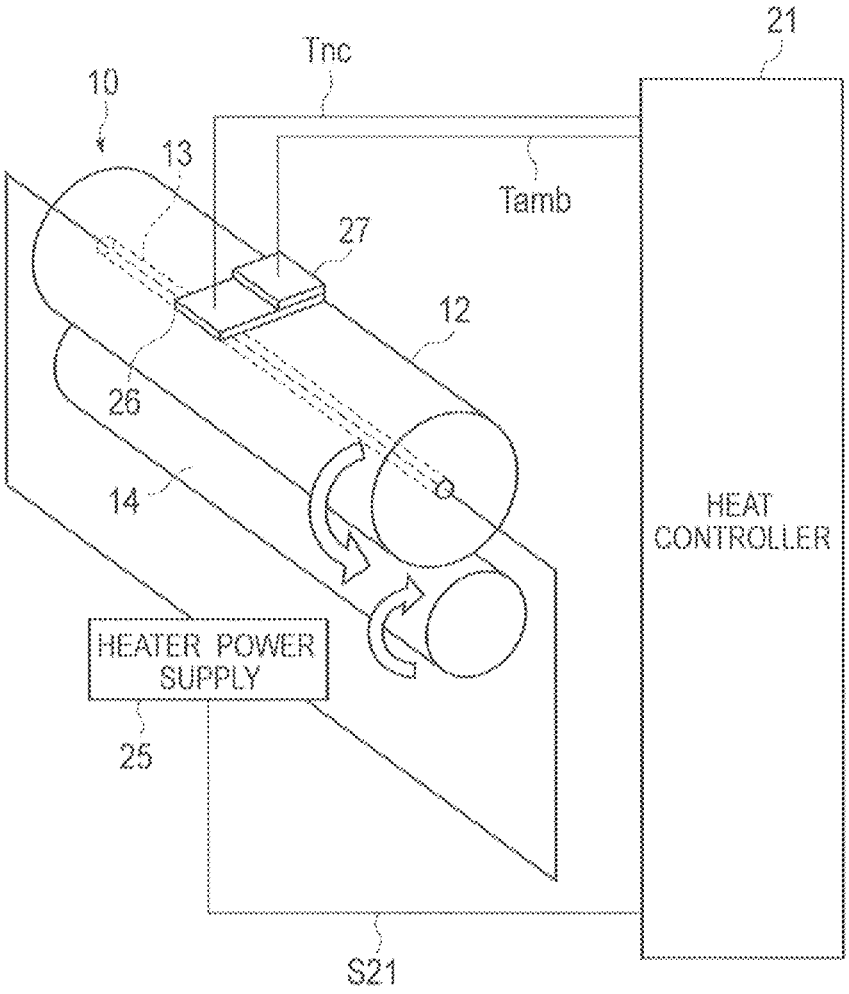
FIG. 3 is a schematic diagram illustrating a configuration of a roller-type fixation unit and the heat controller illustrated in FIG. 2.
Figure 4A:
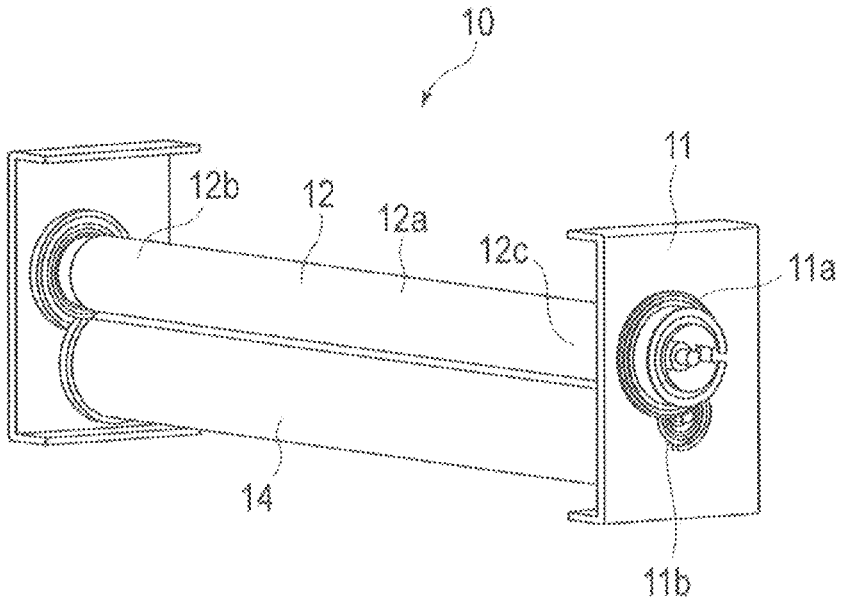
FIGS. 4A and 4B are schematic configuration diagrams illustrating the fixation unit illustrated in FIG. 3.
Figure 4B:
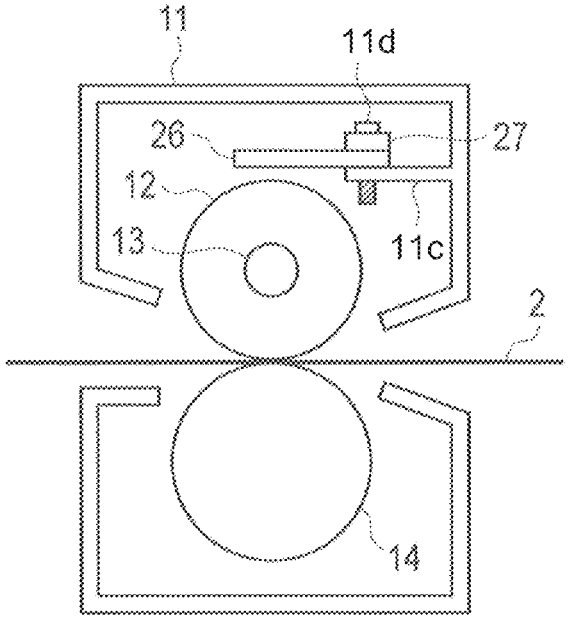

FIG. 3 is a schematic diagram illustrating the configuration of roller-type fixation unit 10 and heat controller 21 illustrated in FIG. 2. FIGS. 4A and 4B are schematic configuration diagrams illustrating fixation unit 10 illustrated in FIG. 3. FIG. 4A is a perspective view of fixation unit 10, while FIG. 4B is a magnified view of a longitudinal section of fixation unit 10 illustrated in FIG. 4A.

Fixation unit 10 includes: fixation roller 12 for supplying heat to sheet 2 and for transporting sheet 2; fixation heater 13 for heating fixation roller 12 from inside fixation roller 12; pressure roller 14 in pressure contact with fixation roller 12. Fixation heater 13 is disposed inside fixation roller 12 in a way that fixation heater 13 is out of contact or in contact with fixation roller 12. Among middle portion 12*a* and two end portions 12*b*, 12*c* of fixation roller 12, two end portions 12*b*, 12*c* are supported by support member 11 using rolling bearings 11*a* as rotatable support members. Similarly, two end portions of pressure roller 14 are supported by support member 11 using rolling bearings 11*b* as rotatable support members. Fixation roller 12 and pressure roller 14 rotate reversely to each other in the arrowed directions in FIG. 3.

Fixation roller 12 includes a core bar made of an aluminum element tube as a base body with an outer diameter of 30 mm. Fixation roller 12 includes gears which are not illustrated, and is designed such that: transport rollers 5*a* to 5*d* rotationally drive the gears; and the thus-driven gears rotationally drive fixation roller 12. An elastic body such as a spring (not illustrated), presses pressure roller 14 against fixation roller 12 in a direction in which pressure roller 14 is brought in pressure contact with fixation roller 12. Pressure roller 14 is in contact with fixation roller 12, and they form a nip section.

Support member 11 is provided with protrusion 11*c* projecting to the vicinity of the surface of fixation roller 12. Non-contact thermistor 26 and compensation thermistor 27 are fixed to protrusion 11*c* with screw 11*d*. Non-contact thermistor 26 is disposed at a position which allows non-contact thermistor 26 to detect the temperature of the vicinity of the surface of fixation roller 12 (for instance, the vicinity of middle portion 12*a*) without contact. Compensation thermistor 27 is disposed at a position which allows compensation thermistor 27 to detect the temperature of protrusion 11*c*. Non-contact thermistor 26 and compensation thermistor 27 are thermosensitive devices which change their resistance values in accordance with the temperature. Heat controller 21 detects the resistance values of non-contact thermistor 26 and compensation thermistor 27, and thereby detects the temperatures of non-contact thermistor 26 and compensation thermistor 27. Non-contact thermistor 26 and compensation thermistor 27 of Embodiment 1 use negative characteristic thermistors which decreases their resistance values in accordance with an increase in the temperature, for instance.

On the basis of detection temperature Tnc from non-contact thermistor 26 and compensation temperature Tamb from compensation thermistor 27, heat controller 21 detects surface temperature Tc of fixation roller 12 without contact. This detection method is expressed with $$Tc=\alpha\times(Tnc-Tamb)+Tamb$$

where $\alpha$ denotes an experimentally-obtained coefficient (1.2, for instance).

For instance, if Tnc=150° C. and Tamb=30° C., surface temperature Tc of fixation roller 12 is obtained as follows:

$$Tc=1.2\times(150-30)+30=174^\circ\ C.$$

Figure 5A:
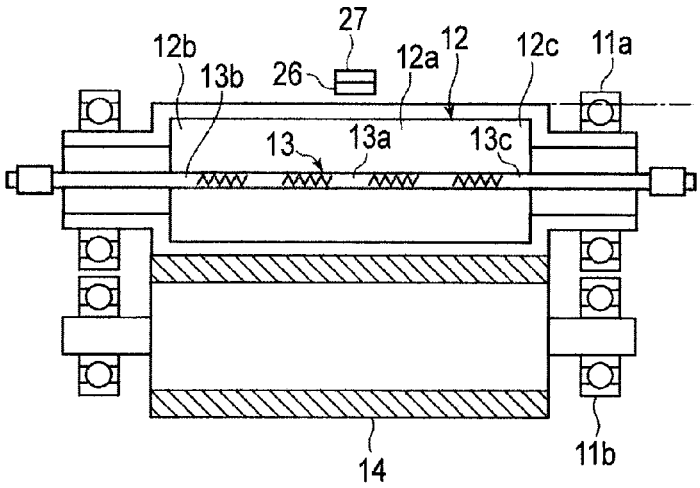
FIGS. 5A to 5C are diagrams for explaining a schematic configuration of the fixation unit illustrated in FIGS. 4A and 4B.
Figure 5B:
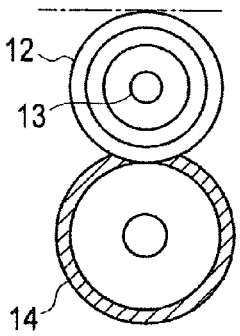
Figure 5C:
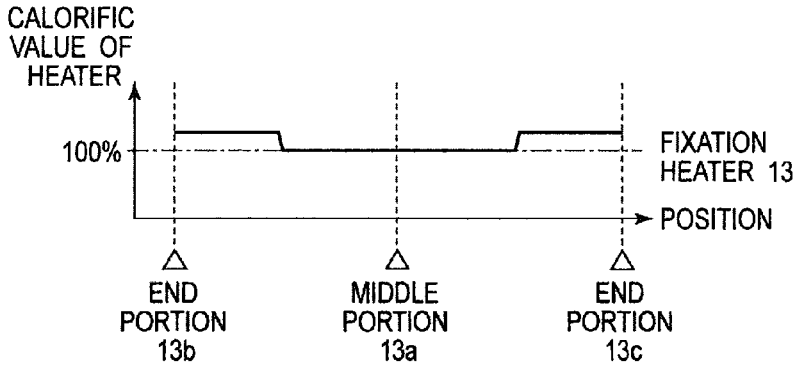

FIGS. 5A to 5C are diagrams for explaining a schematic configuration of fixation unit 10 illustrated in FIGS. 4A and 4B. FIG. 5A is a magnified longitudinal cross-sectional view of fixation unit 10 illustrated in FIG. 4A. FIG. 5B is a schematic side view of fixation unit 10 illustrated in FIG. 5A. FIG. 5C is a diagram of the distribution of calorific values of fixation heater 13 illustrated in FIG. 5A. In FIG. 5C, the horizontal axis indicates longitudinal positions along fixation heater 13 (namely, positions of middle portion 13*a* and two end portions 13*b*, 13*c*, respectively), and the vertical axis indicates the calorific value of the heater.

As illustrated in FIGS. 5A and 5B, single fixation heater 13 is disposed inside fixation roller 12. As illustrated in FIG. 5C, the longitudinal distribution of calorific values of fixation heater 13 is designed such that two end portions 13*b*, 13*c* generate more heat than middle portion 13*a*.

Figure 6A:
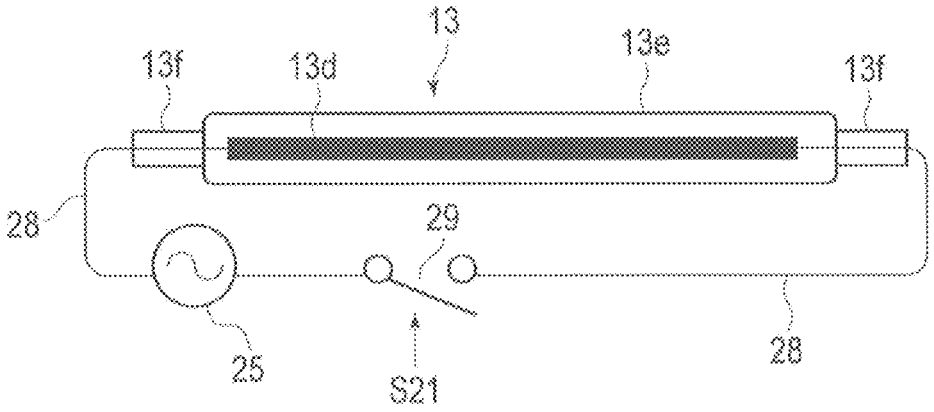
FIGS. 6A and 6B are schematic diagrams illustrating the configuration of a fixation heater and a heater power supply illustrated in FIG. 5A.
Figure 6B:
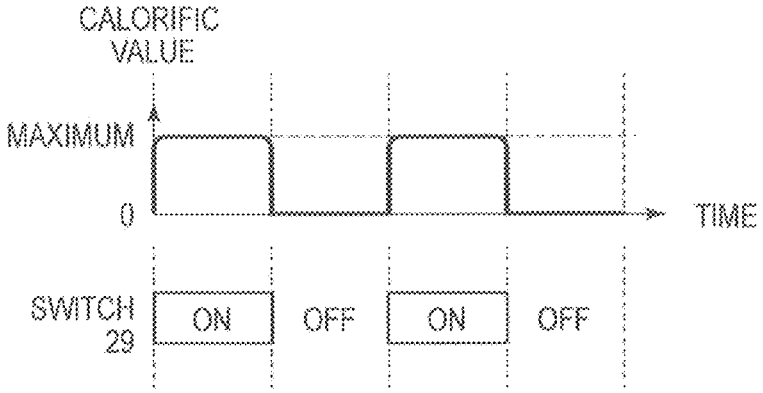

FIGS. 6A and 6B are schematic diagrams illustrating the configuration of fixation heater 13 and heater power supply 25 illustrated in FIG. 5A. FIG. 6A is the configuration diagram of fixation heater 13 and heater power supply 25, and FIG. 6B is the diagram illustrating ON and OFF states of fixation heater 13 illustrated in FIG. 6A. In FIG. 6B, the horizontal axis indicates time, and the vertical axis indicates calorific values in the ON and OFF states of fixation heater 13.

As illustrated in FIG. 6A, fixation heater 13 is, for instance, a halogen lamp, and includes filament 13*d* as a heat generation element. Filament 13*d* is enclosed in glass tube 13*e*. Support member 11 supports filament 13*d* inside fixation roller 12. The two end portions of glass tube 13*e* are provided with insulators 13*f*, respectively. Insulators 13*f* electrically insulate filament 13*d* from support member 11. In insulators 13*f*, the two ends of filament 13*d* are connected to heater wiring 28 for electric power transmission. Filament 13*d* is connected to AC heater power supply 25 with heater wiring 28 via switch for controlling the electric power supply. Switch 29 performs on and off operations depending on control signal S21 outputted from heat controller 21, and thereby controls the supply and cutoff of the electric power from heater power supply 25 to fixation heater 13.

In this respect, a tungsten filament or the like is used for filament 13*d*, for instance. Filament 13*d*, together with an inert gas such as argon or krypton, bromine, chlorine or the like in the form of a halogenated organic compound, is enclosed in glass tube 13*e*. When heated and cooled, a halogen cycle is created between the tungsten and a halogen produced from the halogenated organic compound. Thereby, fixation unit 10 is capable of offering the heating function over its lifespan. Insulation members such as ceramic members are used for insulators 13*f*, for instance. Furthermore, a semiconductor switch such as a triac capable of transmitting a large current is used for switch 29.

In the circuit illustrated in FIG. 6A, when switch 29 is in an ON state, AC power (with an AC voltage of 100 V, for instance) supplied from heater power supply 25 is sent to filament 13*d* via heater wiring 28, and filament 13*d* generates heat (with an output power of 1200 W, for instance) using the power. Glass tube 13*e* is transparent. Glass tube 13*e* is designed to transmit heat generated by the heat generation of filament 13*d*, and to send the heat to an inner surface of the core bar of fixation roller 12.

FIG. 6B illustrates a relationship between the ON and OFF states of switch 29 and the calorific value of fixation heater 13. Switch 29 can create only the two states, namely corresponding to the supply and cutoff of the AC power from heater power supply 25. For this reason, the controlling of the amount of heat applied to fixation roller 12 is achieved by controlling the length of heating time within a predetermined period of time.

FIG. 5C illustrates the distribution of the calorific values of fixation heater 13 illustrated in FIG. 6A, which is installed in fixation unit 10 illustrated in FIG. 5A.

As illustrated in FIG. 5C, the longitudinal distribution of the calorific values of fixation heater 13 is designed such that two end portions 13*b*, 13*c* generate more heat than middle portion 13*a*. The reason for this is as follows.

Fixation roller 12 is designed to be rotatable since fixation roller 12 needs to transport sheet 2 while sheet 2 is interposed between fixation roller 12 and pressure roller 14. Support member 11 supports the two end portions 12*b*, 12*c* of fixation roller 12 with rotatable rolling bearings 11*a* interposed in between. For this reason, part of the heat transmitted to fixation roller 12 by the heat generation of fixation heater 13 is transferred to support member 11 via rolling bearings 11*a*. Because support member 11 needs strength, support member 11 needs to be large and solid. As a result, support member 11 needs a larger quantity of heat for the purpose of raising its own temperature, and the quantity of heat needed by support member 11 for the purpose is extremely greater than that needed by fixation roller 12. In other words, the heat capacity of support member 11 is extremely greater than that of fixation roller 12.

Accordingly, particularly when the heating of fixation roller 12 is started from a state where the entirety of fixation unit 10 is cooled down to room temperature, the temperature of middle portion 12*a* of fixation roller 12 rises, but the temperatures of two longitudinal end portions 12*b*, 12*c* of fixation roller 12 do not rise enough higher than room temperature since part of the heat of two longitudinal end portions 12*b*, 12*c* of fixation roller 12 is transferred (radiated) to support member 11. For this reason, there is the likelihood that a fixation failure occurs. For the purpose of preventing the fixation failure at the time of print start, Embodiment 1 sets the higher calorific value for two end portions 13*b*, 13*c* of fixation heater 13.

(Working of Embodiment 1)

For the purpose of clarifying how Embodiment 1 works, descriptions are provided for (I) how the image formation apparatus works as a whole, (II) how Comparative Example works for fixation control, and (III) how Embodiment 1 works for fixation control.

(I) Working of Embodiment 1 as a Whole

Referring to FIGS. 1 and 2, for instance once print controller 20 receives a print instruction from host apparatus 19, print controller 20 drives LED head 8, toner image formation unit power supply 22, and motor power supply 23 by outputting a control signal. Furthermore, print controller 20 turns switch 29 (illustrated in FIG. 6) on by outputting control signal S21, and thereby makes heater power supply 25 output AC power.

Once motor power supply 23 is driven, sheet transport motor 24 rotates, and hopping roller 4 and transport rollers 5*a* to 5*d* on sheet transport passage 5 operate. The operation of hopping roller 4 feeds sheet 2 from inside sheet cassette 3 to sheet transport passage 5. Transport rollers 5*a*, 5*b* transport thus-fed sheet 2 to write start sensor 6 located downstream of transport rollers 5*a*, 5*b*. Thereafter, on the basis of the detection by write start sensor 6, sheet 2 is transported to toner image formation unit 7 by being timed to coincide with the image formation.

Depending on the print information such as sheet width information from sheet width setter 18*a*, LED head 8 emits record light onto photosensitive drum 7*a* inside toner image formation unit 7. Thereby, depending on the thus-emitted record right, transfer roller 7*b* inside toner image formation unit 7 transfers a toner image onto sheet 2. Sheet 2, onto which the toner image is transferred, is transported to fixation unit 10, where fixation roller 12 and pressure roller 14 fix the toner image to sheet 2 with heat and pressure. Transport rollers 5*c*, 5*d* deliver sheet 2 to which the toner image is fixed to stacker 15 outside housing 1. The operation for the image formation ends with this.

(II) Working of Comparative Example for Fixation Control

Figure 7A:
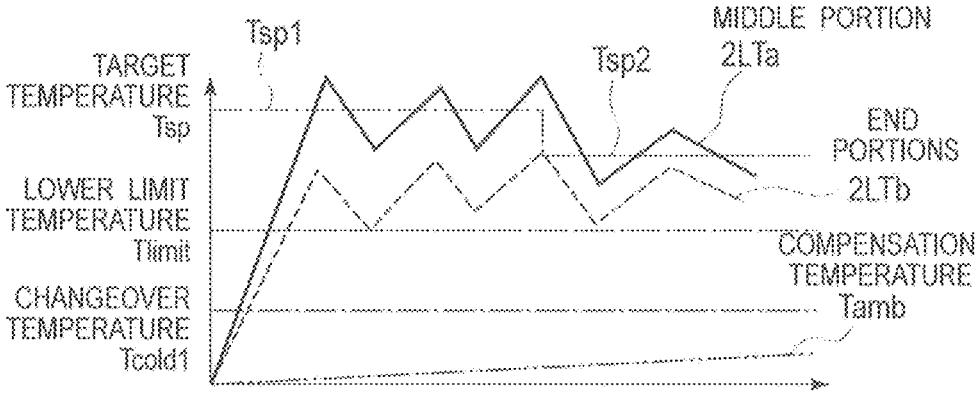
FIGS. 7A and 7B are diagrams for explaining how in a Comparative Example, a print controller performs temperature control on a fixation unit, and how temperatures change.
Figure 7B:
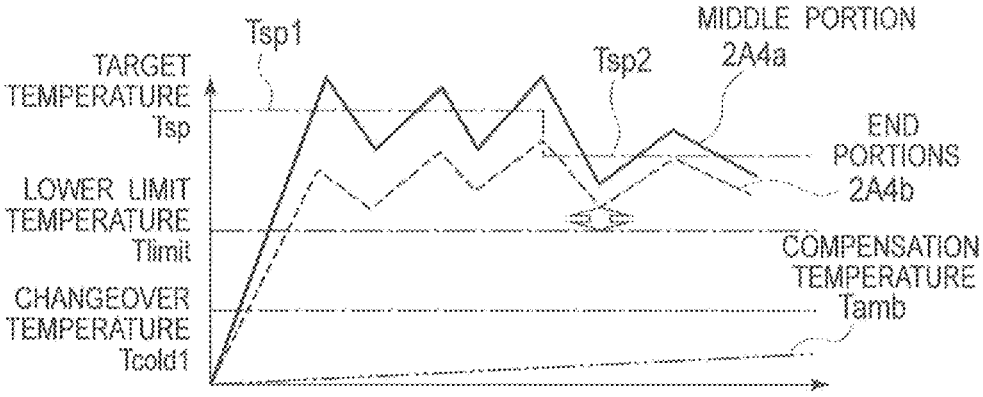

FIGS. 7A and 7B are diagrams for explaining how a Comparative Example controls temperatures of a fixation unit, and how the temperatures change. FIG. 7A is the diagram illustrating how the temperatures change while under the control of the Comparative Example, with the printing being made on letter-size sheets 2LT whose width is a maximum printable width. FIG. 7B is the diagram illustrating how the temperatures change while under the control of the Comparative Example, with the printing being made on A4-size sheets 2A4 whose width is narrower than that of letter-size sheets 2LT.

FIGS. 7A and 7B each illustrate how the temperature of each part of the fixation unit of the Comparative Example changes with time while the temperature is rising (warming up) from room temperature, and while the temperature is controlled on the basis of predetermined temperatures. In FIGS. 7A and 7B, the horizontal axis indicates time, and the vertical axis indicates temperatures (target temperature Tsp, lower limit temperature Tlimit, and changeover temperature Tcold1).

As illustrated in FIG. 7A, when the printing is made on letter-size sheet 2LT whose width is a maximum printable width, the temperatures of middle portion 2LTa and each end portion 2LTb of sheet 2LT are controlled in a way that the temperature of each end portions 2LTb becomes equal to a temperature which is not less than lower limit temperature Tlimit, but is the lowest above lower limit temperature Tlimit; and power consumption is minimized within a range where no printing failure occurs.

In contrast to this, as illustrated in FIG. 7B, when the same control as illustrated in FIG. 7A is performed on the printing to be made on A4-size sheet 2A4 whose width is narrower, the temperatures of middle portion 2A4*a* and each end portion 2A4*b* of sheet 2A4 are controlled in a way that the temperature of each end portion 2A4*b* becomes equal to a temperature which is unnecessarily higher than lower limit temperature Tlimit; and although no printing failure occurs, there is room for improvement in power consumption because the power consumption is not sufficiently low.

The reason for the difference between the case illustrated in FIG. 7A and the case illustrated in FIG. 7B is that although the width of the heat generation element in fixation heater 13 remains unchanged between the two cases, the width of the sheet from which heat is dissipated is different between sheet 2LT and sheet 2A4, and the quantity of heat dissipated from fixation roller 12 is smaller at end portions 2A4*b* of sheet 2A4 than at end portions 2LTb of sheet 2LT because the width of sheet 2A4 is narrower than that of sheet 2LT. As a result, even though the input heat quantity from fixation heater 13 as a whole is the same between the two cases, the quantity of heat remaining at end portions 12*b*, 12*c* of fixation roller 12 is larger in the case of the narrower sheet width, and the temperatures of the end portions are accordingly higher in the case of the narrower sheet width. In other words, when the temperatures of the end portions are raised to the same level, the narrower sheet width requires a smaller input heat quantity.

The following descriptions are provided for how the fixation control employed in Embodiment 1 works in order to solve the problem with a Comparative Example like this.

(III) Working of Embodiment 1 for Fixation Control

Figure 8A:
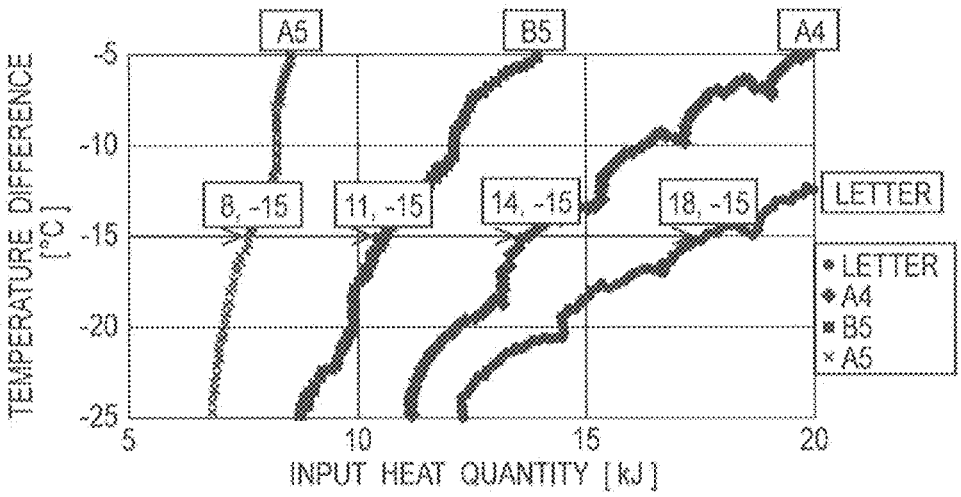
FIGS. 8A and 8B are diagrams for explaining characteristics of the fixation unit illustrated in FIGS. 5A to 5C.
Figure 8B:
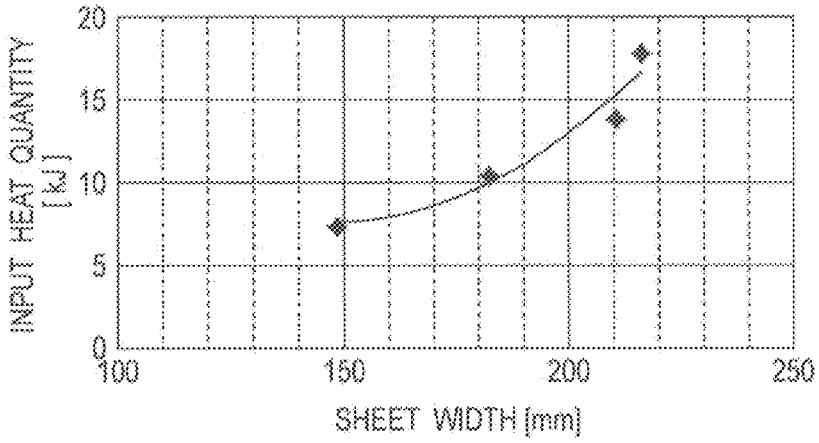

FIGS. 8A and 8B are diagrams for explaining characteristics of fixation unit 10 illustrated in FIGS. 5A to 5C. FIG. 8A is the diagram illustrating a relationship which is observed during printing between the input heat quantity [kJ] (indicated by the horizontal axis) and the temperature difference [° C.] (indicated by the vertical axis) between middle portion 12*a* and end portions 12*b*, 12*c* of fixation roller 12 for each of sheet widths (the letter-size width, the A4-size width, the B5-size width and the A5-size width). As for the sheet width, the letter size measures 215.9 mm wide×279.4 mm long; the A4 size measures 210 mm wider 297 mm long; the B5 size measures 182 mm wide×257 mm long; and the A5 size measures 148 mm wide×210 mm long.

In addition, FIG. 8B is a graph which, for each sheet width [mm], illustrates an input heat quantity [kJ] needed to satisfy a condition where the temperature difference [° C.] in FIG. 8A is minus 15 [ ° C.]. That is, FIG. 8B illustrates a relationship between each sheet width [mm] (indicated by the horizontal axis) and the corresponding input heat quantity [kJ] (indicated by the vertical axis).

As illustrated in FIG. 8A, it is learned that as the sheet width becomes wider, the input heat quantity needed to bring the temperatures of the end portions closer to the temperature of the middle portion becomes larger. Furthermore, as illustrated FIG. 8B, it is learned that even though the sheet width difference between each of the two sizes close to each other, such as between the letter size and the A4 size, is small, the change in the needed input heat quantity is large between the two sizes.

The reason for this is that: although the width of the heat generation element in fixation heater 13 remains unchanged among the four sizes, the width of the sheet from which heat is dissipated is different from one another; and as the width of sheet 2 becomes narrower, the quantity of heat dissipated from fixation roller 12 in the sheet end portions becomes smaller. As a result, even though the equal input heat quantity is inputted from fixation heater 13, the narrower sheet width makes the temperatures of the end portions become higher since the quantity of heat remaining at end portions 12*b*, 12*c* of fixation roller 12 becomes larger. In other words, as the sheet width becomes narrower, the input heat quantity needed to raise the temperatures of the end portions to the same level becomes smaller.

Based on the relationship between the sheet width and the temperature difference between the middle portion and the end portions for each sheet size as illustrated in FIG. 8B, Embodiment 1 uses the quantity of heat supplied to fixation roller 12 (namely, the input heat quantity), which makes particularly the temperature difference between the middle portion and the end portions become necessarily and sufficiently small, as a value for the input heat quantity judgment. In other words, for each of the sheet widths of the sheets on which printing is made, if the input heat quantity is less than the corresponding value in FIG. 8B, the quantity of heat inputted into end portions 12*b*, 12*c* of fixation roller 12 can be judged as insufficient and the temperatures of the sheet end portions also can be judged as insufficient. Embodiment 1 performs the control by employing the foregoing characteristics.

Embodiment 1 performs the fixation control as follows. Once print controller 20 receives the print instruction, print controller 20 makes sheet transport motor 24 rotate fixation roller 12 via gears (not illustrated). Subsequently, heat controller 21 judges whether or not the temperature of fixation roller 12, obtained by correcting detection temperature Tnc of fixation unit 10 detected by non-contact thermistor 26 using compensation temperature Tamb detected by compensation thermistor 27, falls within a predetermined printable temperature range. If the temperature of fixation roller 12 falls within the range, print controller 20 starts to transport sheet 2.

The printable temperature range is a temperature range which enables toner to be normally fixed to sheet 2, and which has a lower limit temperature Tlimit (160° C., for instance) and an upper limit temperature T2 (200° C., for instance). If the temperature is higher than upper limit temperature T2, heat controller 21 turns off switch 29 (illustrated in FIG. 6A) using control signal S21, stops the supply of the power to fixation heater 13 from heater power supply 25, and thereby decreases (or cools down) the temperature of fixation roller 12. In contrast to this, if the temperature is lower than lower limit temperature Tlimit, heat controller 21 turns on switch 29 (illustrated in FIG. 6A) using control signal S21, supplies the power to fixation heater 13 from heater power supply 25, and thereby increases (warms up) the temperature of fixation roller 12.

Figure 9:
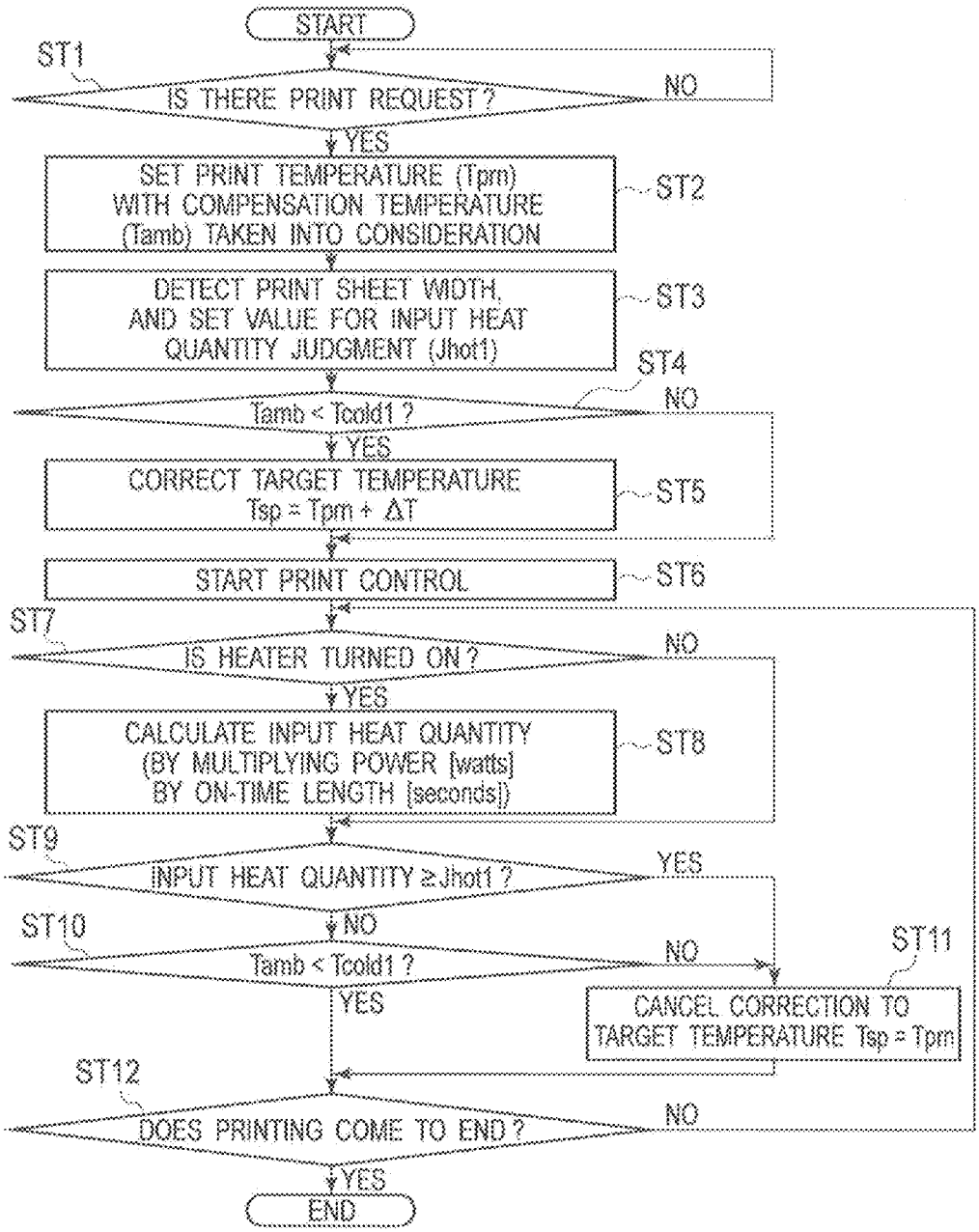
FIG. 9 is a flowchart illustrating the processes for temperature control on the fixation unit illustrated in FIG. 1.

FIG. 9 is a flowchart illustrating the processes for temperature control on fixation unit 10 illustrated in FIG. 1. Once print controller 20 starts to perform the temperature control on fixation unit 10, the process flow proceeds to step ST1. In step ST1, print controller 20 detects whether or not a print request occurs from host apparatus 19. If no print request occurs (if N), print controller 20 waits for a print request to occur. If a print request occurs (if Y), the process flow proceeds to step ST2.

In step ST2, heat controller 21 detects the temperature of protrusion 11*c* of support member 11 from compensation temperature Tamb detected by compensation thermistor 27. In addition, print controller 20 sends the contents of the print request from host apparatus 19 to heat controller 21. Heat controller 21 sets print temperature Tprn which heat controller 21 judges as optimal from information on the received contents of the print request. For the purpose of making the temperature of fixation roller 12 becomes equal to print temperature Tprn, heat controller 21 supplies and cuts off the power from heater power supply 25 by turning on and off switch 29 (illustrated in FIG. 6A) using control signal S21, and thereby controls the drive of fixation heater 13. Print temperature Tprn is a temperature set optimal for each print condition. Print temperature Tprn is experimentally obtained, and is stored in storage 20*a* in print controller 20 in advance. Thereafter, the process flow proceeds to step ST3.

In step ST3, print controller 20 detects the print sheet width set with sheet width setter 18*a*, and sets the value for input heat quantity judgment Jhot1, as an optimal value for heat quantity judgment, from information on the detection. The value for input heat quantity judgment Jhot1 can be obtained by being selected from the relationships illustrated in FIG. 11B which are experimentally obtained with the foregoing method in advance (namely, the relationships between the sheet widths and values for input heat quantity judgment Jhot1. For instance, Jhot1=18 kJ for printing to be made on letter-size sheet 2LT, and Jhot1=14 kJ for printing to be made on A4-size sheet 2A4. Thereafter, the process flow proceeds to step ST4.

In step ST4, heat controller 21 compares compensation temperature Tamb with changeover temperature Tcold1 which is set as the reference in advance. If Tamb≥Tcold1, or if compensation temperature Tamb is not less than changeover temperature Tcold1 (if N), heat controller 21 judges that fixation unit 10 warms up to a necessary and sufficient extent, and the process flow proceeds to step ST6 without correcting target temperature Tsp (target temperature Tsp=print temperature Tprn). If Tamb<Tcold1, or if compensation temperature Tamb is less than changeover temperature Tcold1 (if Y), heat controller 21 judges that the temperature of fixation unit 10 is lower. Thereafter, the process flow proceeds to step ST5.

In step ST5, heat controller 21 corrects target temperature Tsp (in a way that target temperature Tsp=print temperature Tprn+correction temperature ΔT) since the temperature of fixation unit 10 is lower. Thereafter, the process flow proceeds to step ST6. In this respect, for instance, target temperature Tsp=200° C. when print temperature Tprn=180° C. and correction temperature ΔT=20° C.

As compensation temperature Tamb becomes lower, heat controller 21 judges that the temperature of fixation unit 10 cools to a lower temperature, and thereby corrects target temperature Tsp so as to make target temperature Tsp become higher. The reason for this is that lower compensation temperature Tamb enables heat controller 21 to judge that the temperatures of rolling bearings 11*a* supporting fixation roller 12 are lower. As the temperatures of rolling bearings 11*a* become lower, the quantity of heat dissipated from end portions 12*b*, 12*c* of fixation roller 12 which are in contact with, and supported by, rolling bearings 11*a* becomes larger, leading to a phenomenon that the temperatures of the end portions of fixation roller 12 become lower. For the purpose of compensating for the decrease in the temperature of fixation roller 12, heat controller 21 sets target temperature Tsp higher.

In step ST6, once print controller 20 judges that the temperature of fixation unit 10 falls within a print start enabling temperature range, print controller 20 starts printing. Thereafter, the process flow proceeds to step ST7. In step ST7, heat controller 21 makes heater power supply 25 supply the AC power to fixation heater 13 by turning on switch 29 (illustrated in FIG. 6) using control signal S21, and thereby turns on fixation heater 13 (Y). Thereafter, the process flow proceeds to step ST8. If heat controller 21 does not turn on fixation heater 13 (if N), the process flow proceeds to step ST9.

In step ST8, heat controller 21 calculates the input heat quantity (by multiplying the power in watts by the ON-time length in seconds) from the ON state of fixation heater 13. Thereafter, the process flow proceeds to step ST9. The input heat quantity is, for instance, a quantity in joules which are units of energy. One may consider that, for instance, the following method is suitable as a method of calculating the input heat quantity. As described above, heat controller 21 controls fixation heater 13 in a way that the calorific value of fixation heater 13 is either 100% or 0%. For this reason, if for instance, the 100% of the calorific value is 1200 W, the input heat quantity [kJ] can be obtained by multiplying the calorific value [in watts] by the time length [in seconds] for which fixation heater 13 is in the ON state.

In step ST9, heat controller 21 compares the calculated input heat quantity up to now with the value for input heat quantity judgment Jhot1. If input heat quantity≥Jhot1, or if the input heat quantity is not less than the value for input heat quantity judgment Jhot1 (if Y), the process flow proceeds to step ST11. In step ST11, heat controller 21 judges that end portions 12*b*, 12*c* of fixation roller 12 sufficiently warm up as a result of inputting a necessary and sufficient heat quantity into fixation unit 10, and cancels the correction to target temperature Tsp (target temperature Tsp=print temperature Tprn). Thereafter, the process flow proceeds to step ST12.

In step ST9, if the input heat quantity<Jhot1, or if the input heat quantity is less than the value for input heat quantity judgment Jhot1 (if N), heat controller 21 judges that the temperatures of end portions 12*b*, 12*c* of fixation roller 12 are lower as a result of inputting an insufficient input heat quantity into fixation unit 10, and continues correcting target temperature Tsp. Thereafter, the process flow proceeds to step ST10. In step ST10, heat controller 21 compares compensation temperature Tamb and changeover temperature Tcold1, like in step ST4. If heat controller 21 judges that fixation unit 10 sufficiently warms up (if N), the process flow proceeds to step S11. In step S11, heat controller 21 cancels the correction to target temperature Tsp (target temperature Tsp=print temperature Tprn). Thereafter, the process flow proceeds to step S12. In step S10, if heat controller 21 judges that fixation unit 10 remains yet to warm up (if Y), then heat controller 21 continues correcting target temperature Tsp. Thereafter, the process flow proceeds to step ST12.

In step ST12, print controller 20 detects whether or not the printing comes to an end. If the printing does not come to an end (if N), the process flow repeats steps ST7 through ST12. If the printing comes to an end (if Y), print controller 20 terminates the temperature control.

Figure 10A:
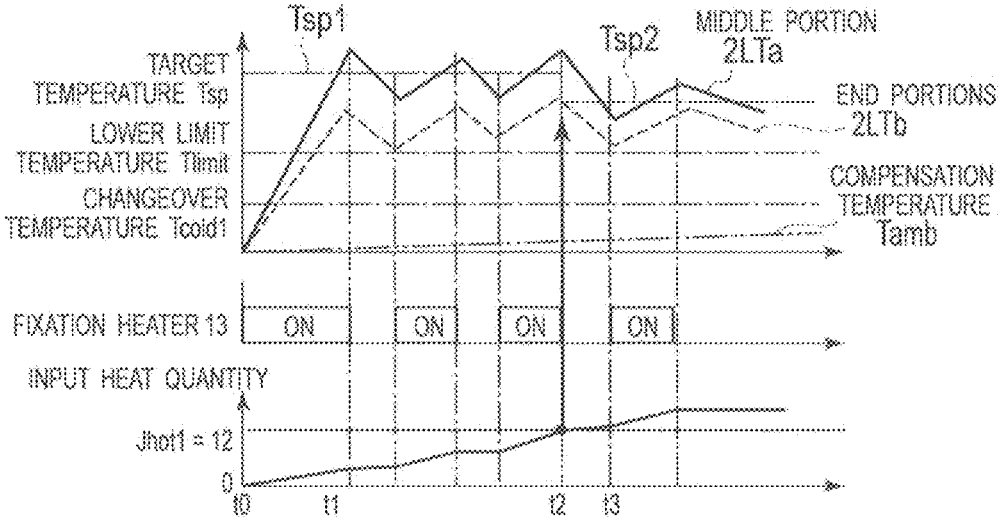
FIGS. 10A and 10B are diagrams for explaining how a print controller performs the temperature control once the print controller receives a print request while the fixation unit illustrated in FIGS. 5A to 5C is fully cooled, and how temperatures change.
Figure 10B:
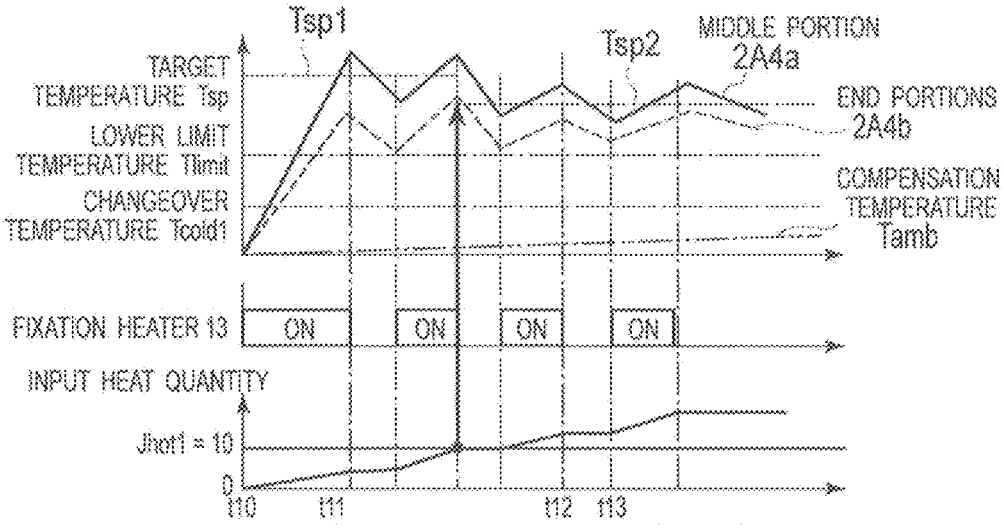

FIGS. 10A and 10B are diagrams each illustrating how print controller 20 performs the temperature control once print controller 20 receives a print request while fixation unit 10, illustrated in FIGS. 5A to 5C, fully cools down, and how temperatures change. FIG. 10A is the diagram for the printing on letter-size sheets 2LT, and FIG. 10B is the diagram for the printing on A4-size sheets 2A4.

The upper half of each of FIGS. 10A and 10B is a graph illustrating how the temperatures of the respective parts change with time. The horizontal axis in the upper half of FIG. 10A indicates times t0 to t3, . . . , while the horizontal axis in the upper half of FIG. 10B indicates times t10 to t13, . . . . The vertical axis in the upper half of each of FIGS. 10A and 10B indicates temperatures (first target temperature Tsp1 which is a higher target temperature Tsp, second target temperature Tsp2 which is a lower target temperature Tsp, lower limit temperature Tlimit, and changeover temperature Tcold1). The lower half of each of FIGS. 10A and 10B is a graph illustrating ON states of fixation heater 13, and a result of calculating a quantity of heat inputted into fixation roller 12. The horizontal axis in the lower half of FIG. 10A indicates times t0 to t3, . . . , while the horizontal axis in the lower half of FIG. 10B indicates times t10 to t13, . . . . The vertical axis in the lower half of each of FIGS. 10A and 10B indicates the ON states of fixation heater 13, the input heat quantity, and the value for input heat quantity judgment Jhot1.

Under a condition of room temperature, the temperatures of the parts of fixation unit 10 at times t1, t10 in FIGS. 10A and 10B are equal to one another. Once print controller 20 receives the print request while in this state, print controller 20 makes heat controller 21 start to perform the heat control on fixation roller 12, and to heat fixation roller 12. Heat controller 21 detects that compensation temperature Tamb is lower than changeover temperature Tcold1, and sets target temperature Tsp at first target temperature Tsp1 as the correction to target temperature Tsp. As a result, heat controller 21 controls the heating of fixation roller 12 in a way that the temperature of fixation roller 12 becomes higher than print temperature Tprn.

Once the temperature rise reaches the print start enabling temperature range at each of times t1, t11, print controller 20 starts the processes for the printing. Heat controller 21 always continues controlling the heater drive. Thereby, heat controller 21 controls the temperatures of sheet middle portions 2LTa, 2A4*a* in a way that the temperatures thereof become equal to first target temperature Tsp1.

Heat controller 21 always continues calculating the input heat quantity as well. As a result, at each of times t2, t12, if heat controller 21 judges that the input heat quantity exceeds the value for input heat quantity judgment Jhot1, heat controller 21 switches the correction to target temperature Tsp to the setting of target temperature Tsp at second target temperature Tsp2 in exchange for cancelling the setting of target temperature Tsp at first target temperature Tsp1. Thereby, heat controller 21 controls the temperature of fixation roller 12 in a way that the temperature thereof becomes equal to print temperature Tprn. At this time, since the input heat quantity is sufficient, the temperature difference between sheet middle portion 2LTa and sheet end portions 2LTb, as well as the temperature difference between sheet middle portion 2A4*a* and sheet end portions 2A4*b*, becomes sufficiently small. For this reason, after heat controller 21 switches the correction to target temperature Tsp to the setting of target temperature Tsp at second target temperature Tsp2 in exchange for cancelling the setting of target temperature Tsp at first target temperature Tsp1, the temperatures of the end portions do not become lower than lower limit temperature Tlimit, either. Thus, no fixation failure occurs at each of times t3, t13.

It should be noted that the comparison between the cases illustrated in FIGS. 10A and 10B shows that the length of time up until the cancelling of the setting of target temperature Tsp at first target temperature Tsp1 is shorter in the case illustrated in FIG. 10B, namely in the case of the narrower sheet width. The reason for this is that the narrower sheet width makes the value for input heat quantity judgment Jhot1 (=10) become smaller. As a result, because the length of time for which target temperature Tsp is kept set at the higher value (namely, the length of time for which target temperature Tsp is kept set at first target temperature Tsp1) can be made shorter, the image formation apparatus is capable of making the printing with less electric power.

(Effect of Embodiment 1)

According to Embodiment 1, heat controller 21 corrects target temperature Tsp with an optimal input heat quantity depending on the sheet width. For this reason, even in the case of the narrower sheet width, the image formation apparatus is capable of making the printing with a minimum of necessary power consumption, and is accordingly capable of preventing a useless increase in power consumption.

[Embodiment 2]

(Configuration of Embodiment 2)

An image formation apparatus of Embodiment 2 of the invention has the same configuration as that of Embodiment 1, but is different from that of Embodiment 1 in terms of the method by which heat controller 21 controls the heating of fixation roller 12.

(Working of Embodiment 2)

Unlike the way heat controller 21 of Embodiment 1 calculates the input heat quantity, heat controller 21 of Embodiment 2 counts the number of printed print media, and judges that the input heat quantity is smaller when the counted number of printed print media is less than the number of print media for input heat quantity judgment Ncold as a predetermined number of print media for the heat quantity judgment.

Figure 11A:
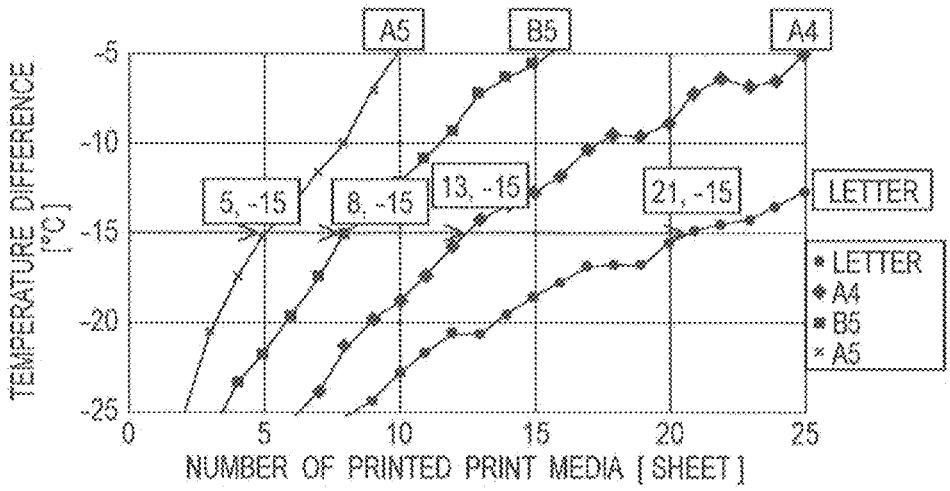
FIGS. 11A and 11B are diagrams for explaining characteristics of a fixation unit of Embodiment 2 of the invention.
Figure 11B:
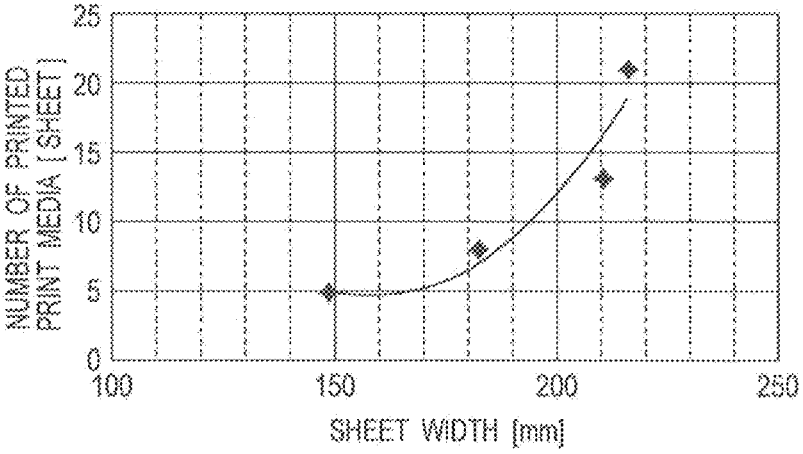

FIGS. 11A and 11B are diagrams for explaining characteristics of fixation unit 10 of Embodiment 2 of the invention (namely, characteristics representing a relationship of each sheet width with the corresponding number of printed print media needed for the temperature difference between the sheet middle portion and end portions to become equal to minus 15° C.). FIG. 11A is the diagram which, for each sheet width, illustrates the relationship of the number of printed print media (indicated by the horizontal axis) with the temperature difference between the middle portion and end portions of each sheet 2 on which printing is made (indicated by the vertical axis). For each sheet width, FIG. 11B graphs the number of printed print media needed for the temperature difference illustrated in FIG. 11A to become equal to minus 15° C. FIG. 11B is the diagram illustrating the relationship of each sheet width (indicated by the horizontal axis) and the corresponding number of printed print media (indicated by the vertical axis)

When one sheet is made to pass through fixation unit 10 illustrated in FIGS. 3, 4A and 4B, sheet 2 with a lower temperature comes into contact with fixation roller 12 in the nip section, which is the section where fixation roller 12 and pressure roller 14 are in contact with each other. Thereby, heat is transferred from fixation roller 12 with a higher temperature to sheet 2 with the lower temperature, and the temperature of fixation roller 12 accordingly becomes lower. Heat controller 21 illustrated in FIG. 3 heats fixation roller 12 with a necessary quantity of heat for the purpose of compensating for the temperature drop which occurs due to the contact of sheet 2 with the nip section.

Thus, as the number of printed print media, which is the number of print media made to pass through fixation unit 10, becomes larger, the quantity of heat transferred from fixation roller 12 to sheets 2 becomes larger, and heat controller 21 heats fixation roller 12 with more quantity of heat. In other words, since the number of printed print media is proportional to the input heat quantity, heat controller 21 is capable of judging whether or not the necessary and sufficient input heat quantity is given to fixation roller 12 from the number of printed print media. If the number of printed print media is not less than the number of print media for input heat quantity judgment, heat controller 21 is capable of judging that the end portions are kept at the necessary and sufficient temperature. Accordingly, no offset occurs even if target temperature Tsp is decreased to second target temperature Tsp2.

In addition, in a case where the image formation apparatus continues making printing by changing the sheet width to a narrower one, heat controller 21 is capable of raising the temperatures of the sheet end portions to the necessary and sufficient temperature in the course of making the printing on a smaller number of print media since the quantity of heat remaining in end portions 12*b*, 12*c* of fixation roller 12 becomes larger.

For instance, while the image formation apparatus is making printing on letter-size sheets 2LT, the relationship illustrated in FIG. 11B makes it possible to judge that a sufficient input heat quantity is given to end portions 12*b*, 12*c* of fixation roller 12 when the number of printed print media exceeds 21. Similarly, while the sheet width is the A4 width, the relationship illustrated in FIG. 11B makes it possible to judge that a sufficient input heat quantity is given to end portions 12*b*, 12*c* of fixation roller 12 when the number of printed print media exceeds 13. Employing the characteristics like these, Embodiment 2 controls the fixation temperature.

Figure 12:
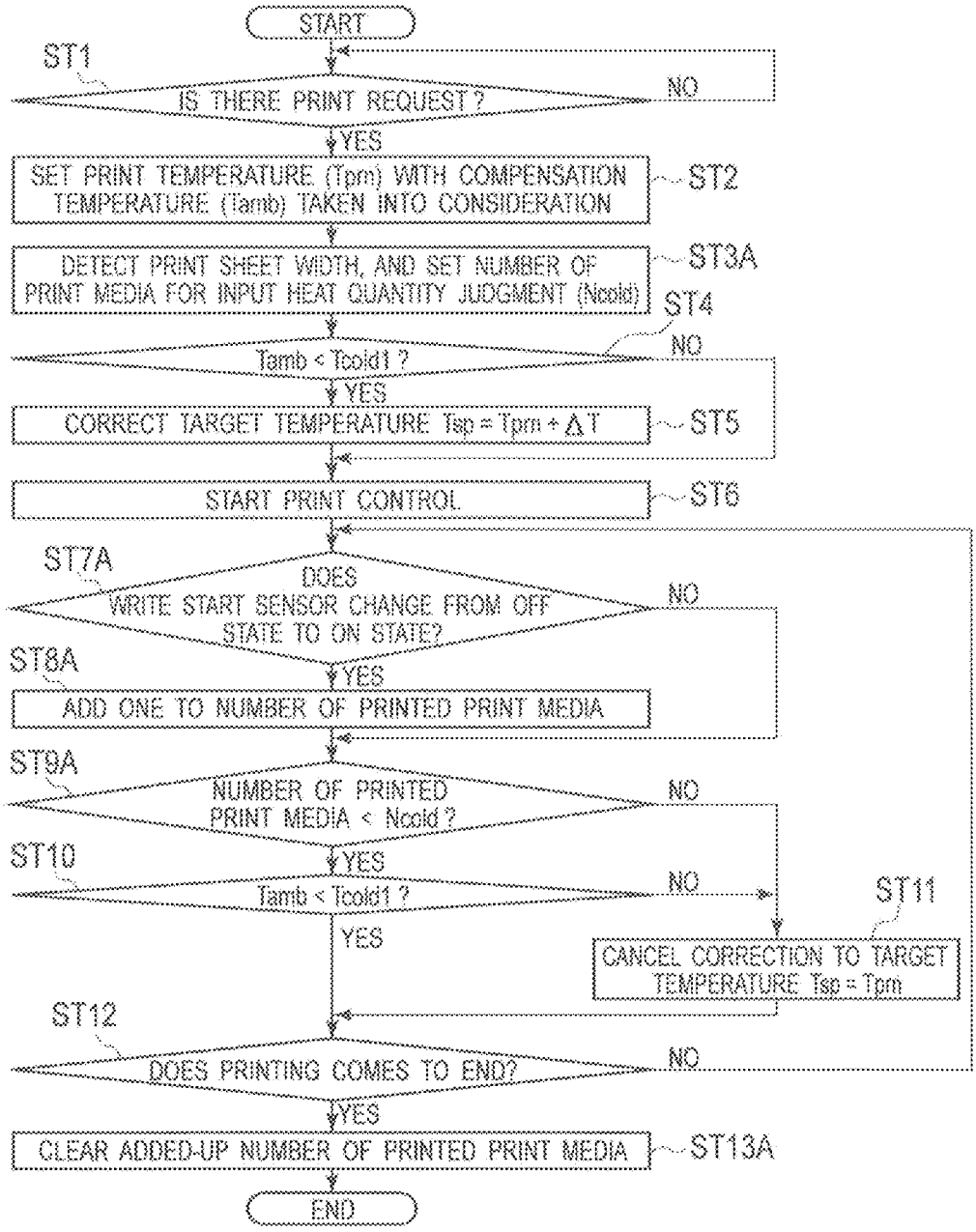
FIG. 12 is a flowchart illustrating the processes for temperature control on the fixation unit of Embodiment 2 which is illustrated in FIG. 1.

FIG. 12 is a flowchart illustrating the processes for temperature control on fixation unit 10 of Embodiment 2 which is illustrated in FIG. 1. Components which are the same as those in FIG. 9 illustrating the flowchart of Embodiment 1 are denoted by the same reference signs.

The processes in steps ST3A, ST7A to ST9A, and ST13A in the flowchart of Embodiment 2 are different from the processes in steps ST3, ST7 to ST9, and ST13 in the flowchart of Embodiment 1.

Once print controller 20 illustrated in FIG. 1 starts to perform the temperature control on fixation unit 10, print controller 20 performs the processes in steps ST1, ST2 which are the same as those in Embodiment 1. Thereafter, the process flow proceeds to step ST3A.

In step ST3A, print controller 20 illustrated in FIG. 1 sets the number of print media for input heat quantity judgment Ncold, which is an optimal number of print media for the judgment, from information on a sheet width which the user sets using sheet width setter 18*a* as a medium width detector. Print controller 20 is capable of obtaining the number of print media for input heat quantity judgment Ncold by selecting it from the relationships illustrated in FIG. 11B which are experimentally obtained in advance using the foregoing method of Embodiment 1 (the relationships between the sheet widths and numbers of sheets for input heat quantity judgment Ncold). Subsequently, print controller 20 performs the processes of steps ST4 to ST6 which are the same as those in Embodiment 1. Thereafter, the process flow proceeds to step ST7A.

In step ST7A, once print controller 20 starts printing, print controller 20 detects the state of write start sensor 6 as the number-of-printed-print-media detector, and thereby detects a change of the state of write start sensor 6 from the OFF state to the ON state. This change is that from the absence to the presence of sheet 2. By detecting this change, print controller 20 is capable of detecting the number of printed print media. Thereafter, the process flow proceeds to step ST8A.

In step ST8A, print controller 20 adds 1 (one) to the current number of printed print media. Thereafter, the process flow proceeds to step ST9A. In step ST9A, print controller 20 compares the number of printed print media, which write start sensor 6 counts, with the number of print media for input heat quantity judgment Ncold beforehand determined and stored. If the number of printed print media is less than the number of print media for input heat quantity judgment Ncold (if Y), print controller 20 performs the process of step ST10 which is the same as that in Embodiment 1.

In step ST9A, if the number of printed print media is not less than the number of print media for input heat quantity judgment Ncold (if N), print controller 20 performs the process of step ST11 which is the same as that in Embodiment 1. The number of print media for input heat quantity judgment Ncold is that which is experimentally obtained in advance, and the number of print media which enables the sheet end portions to obtain the necessary and sufficient temperatures can be obtained experimentally. For instance, the number of print media for input heat quantity judgment Ncold is 21 for the printing on letter-size sheets 2LT, while the number of print media for input heat quantity judgment Ncold is 13 for the printing on A4-size sheets 2A4. Subsequently, print controller 20 performs the process of step ST12 which is the same as that in Embodiment 1. Thereafter, the process flow proceeds to step ST13A. In step ST13A, print controller 20 clears the added-up number of printed print media after the processes for the printing come to an end.

The repetition of the foregoing processes makes it possible to prevent the offset more easily, and to save the energy.

Figure 13A:
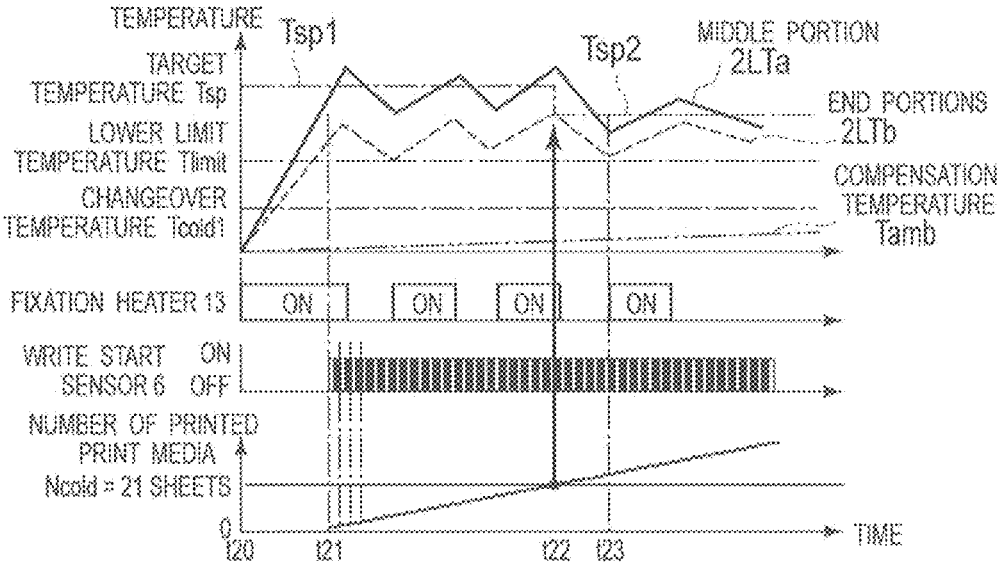
FIGS. 13A and 13B are diagrams for explaining how a print controller performs the temperature control once the print controller receives a print request while the fixation unit of Embodiment 2 illustrated in FIGS. 5A to 5C is fully cooled, and how temperatures change.
Figure 13B:
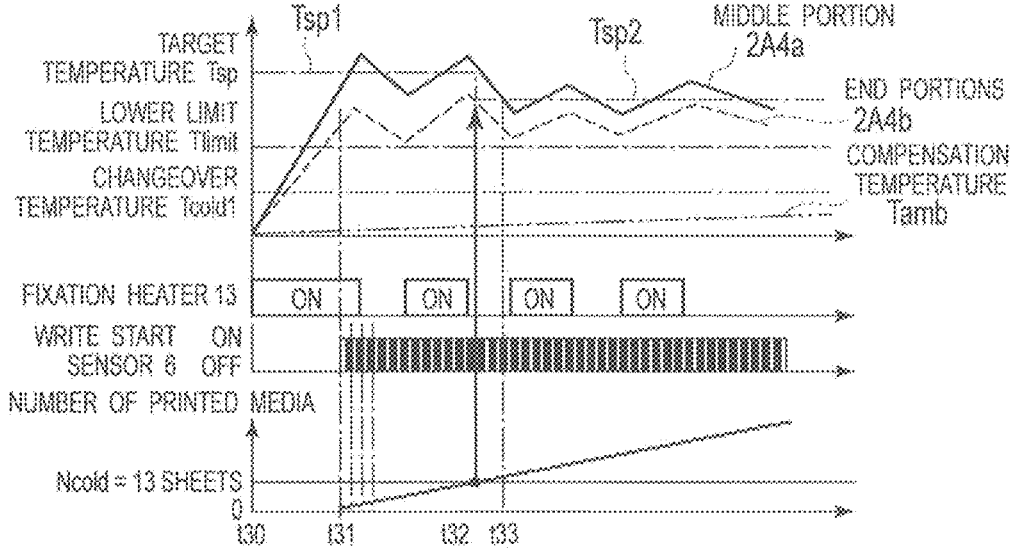

FIGS. 13A and 13B are diagrams each illustrating how print controller 20 performs the temperature control once print controller 20 receives a print request while fixation unit 10 illustrated in FIGS. 5A to 5C fully cools down, and how temperatures change. FIG. 13A is the diagram for the printing on letter-size sheets 2LT, and FIG. 13B is the diagram for the printing on A4-size sheets 2A4.

The upper third of each of FIGS. 13A and 13B is a graph illustrating how the temperatures of the respective parts change with time. The horizontal axis in the upper third of FIG. 13A indicates times t20 to t23, . . . , while the horizontal axis in the upper third of FIG. 13B indicates times t30 to t33, . . . . The vertical axis in the upper third of each of FIGS. 13A and 13B indicates temperatures (first target temperature Tsp1 which is the higher target temperature Tsp, second target temperature Tsp2 which is the lower target temperature Tsp, lower limit temperature Tlimit, and changeover temperature Tcold1). The lower third of each of FIGS. 13A and 13B illustrates ON states of fixation heater 13 and ON states of write start sensor 6. Furthermore, the lowermost third of each of FIGS. 13A and 13B is a graph illustrating how many sheets are printed. The horizontal axis in the lowermost third of FIG. 13A indicates times t20 to t23, . . . , while the horizontal axis in the lowermost third of FIG. 13B indicates times t30 to t33, . . . . The vertical axis in the lowermost third of each of FIGS. 13A and 13B indicates the number of print media for input heat quantity judgment Ncold.

Under a condition of room temperature, the temperatures of the parts of fixation unit 10 at times t20, t30 respectively in FIGS. 13A and 13B are equal to one another. Once print controller 20 receives the print request while in this state, print controller 20 makes heat controller 21 start to perform the heat control on fixation roller 12, and to heat fixation roller 12. Heat controller 21 detects that compensation temperature Tamb is lower than changeover temperature Tcold1, and sets target temperature Tsp at first target temperature Tsp1 as the correction to target temperature Tsp. As a result, heat controller 21 controls the heating of fixation roller 12 in a way that the temperature of fixation roller 12 becomes higher than print temperature Tprn.

Once the temperature rise reaches the print start enabling temperature range at each of times t21, t31, print controller 20 starts the processes for the printing. Heat controller 21 always continues controlling the heater drive. Thereby, heat controller 21 controls the temperatures of sheet middle portions 2LTa, 2A4*a* in a way that the temperatures thereof become equal to first target temperature Tsp1.

Heat controller 21 always continues calculating the number of printed print media as well. As a result, at each of times t22, t32, if heat controller 21 judges that the number of printed print media exceeds the number of print media for input heat quantity judgment Ncold, heat controller 21 switches the correction to target temperature Tsp to the setting of target temperature Tsp at second target temperature Tsp2 in exchange for cancelling the setting of target temperature Tsp at first target temperature Tsp1. Thereby, heat controller 21 controls the temperature of fixation roller 12 in a way that the temperature thereof becomes equal to the print temperature. At this time, since the input heat quantity is sufficient, the temperature difference between middle portion 2LTa and end portions 2LTb of each sheet 2LT, as well as the temperature difference between middle portion 2A4*a* and end portions 2A4*b* of each sheet 2A4, already becomes sufficiently small. For this reason, after heat controller 21 switches the correction to target temperature Tsp to the setting of target temperature Tsp at second target temperature Tsp2 in exchange for cancelling the setting of target temperature Tsp at first target temperature Tsp1, the temperatures of the end portions do not become lower than lower limit temperature Tlimit, either. Thus, no fixation failure occurs at each of times t23, t33.

It should be noted that the comparison between the cases illustrated in FIGS. 13A and 13B shows that the number of printed print media up until the cancelling of the setting of target temperature Tsp at first target temperature Tsp1 (namely, the number of print media printed at first target temperature Tsp1) is smaller in the case illustrated in FIG. 13B, namely in the case of the narrower sheet width. The reason for this is that the narrower sheet width makes the number of print media for input heat quantity judgment Ncold to become smaller. As a result, because the length of time for which target temperature Tsp is kept set at the higher value can be made shorter, the image formation apparatus is capable of making the printing with less electric power.

(Effect of Embodiment 2)

Embodiment 2 can more easily obtain the same effects as Embodiment 1 by use of the number of printed print media instead of by use of the input heat quantity.

(Modifications of Examples 1 and 2)

The invention is not limited to Examples 1 and 2 described above, and can be carried out in various utilization modes and modifications. Examples of such utilization modes and modifications include Modifications (1) to (6) as follows.

(1) The invention is applicable to a fixation unit of a different type, although Examples 1 and 2 describe a roller-type fixation unit 10.

Figure 14:
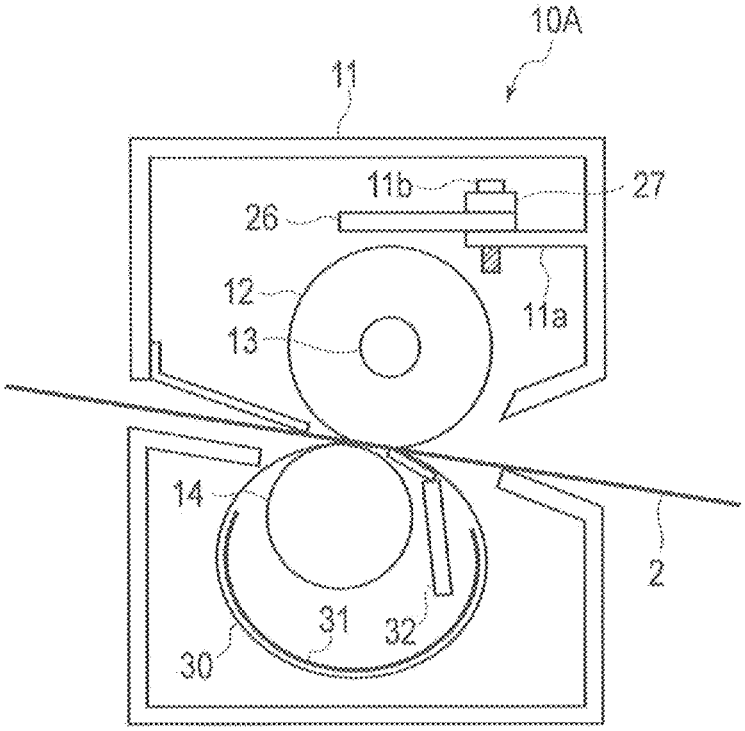
FIG. 14 is a schematic configuration diagram illustrating a belt-type fixation unit.

FIG. 14 is a schematic configuration diagram illustrating a belt-type fixation unit. Components which are the same as those in FIG. 4B illustrating roller-type fixation unit 10 of Embodiment 1 are denoted by the same reference signs.

Belt-type fixation unit 10A is provided with fixation belt guide 31, pressure roller 14 and pressure pad 32 inside fixation belt 30 made of an endless belt. Once sheet 2 onto which a toner image is transferred is transported to belt-type fixation unit 10A, pressure roller 14 and pressure pad 32 press sheet 2 against fixation roller 12 while applying pressure to sheet 2 with fixation belt 30 interposed in between. The area of the contact between fuser roller 12 and fixation belt 30 in belt-type fixation unit 10A is larger than the area of the contact between fuser roller 12 and pressure roller 14 in roller-type fixation unit 10. This makes belt-type fixation unit 10A advantageous over roller-type fixation unit 10 in terms of the transferring of heat to sheet 2 while the image formation apparatus is performing high-speed printing. The use of a belt-type fixation unit 10A like this also can bring about virtually the same working and effect as the use of the roller-type fixation unit 10 of Embodiment 1. Furthermore, the invention is also applicable to fusers whose configurations are different from those illustrated.

(2) Heat controller 21 of Embodiment 1 is designed to change the control condition for performing the temperature control on fuser roller 12 in accordance with compensation temperature Tamb, the input heat quantity, and the detected width of the sheet width. Heat controller 21 of Embodiment 2 is designed to change the control condition for performing the temperature control on fuser roller 12 in accordance with compensation temperature Tamb, the number of printed print media, and the detected width of the sheet width. However, heat controller 21 is not limited to those of Examples 1 and 2. For instance, heat controller 21 may be designed such that: heat controller 21 is provided with a timer for measuring a time length of print duration for which the image formation apparatus continues making printing since starting the printing; and heat controller 21 changes the control condition for performing the temperature control on fuser roller 12 in accordance with compensation temperature Tamb, the time length of print duration, and the detected width of the sheet width.

(3) In Examples 1 and 2, fuser heater 13 is the halogen lamp. However, fuser heater 13 is not limited to the halogen lamp. For instance, a plane heater made of resistance elements may be used as fuser heater 13.

(4) In Examples 1 and 2, compensation thermistor 27 is attached to the position of support member 11 to which non-contact thermistor 26 is attached, in the way that compensation thermistor 27 and non-contact thermistor 26 are integrated into the single unit. However, the attachment position and method of compensation thermistor 27 is not limited to those of Examples 1 and 2. Unlike non-contact thermistor 26, compensation thermistor 27 may be attached to an arbitrary position which enables compensation thermistor 27 to detect the temperature of support member 11.

(5) Examples 1 and 2 explain that the first and second temperature detectors are the thermistors. However, the temperature detectors are not limited to the thermistors. For instance, posistors or the like which exhibit characteristics opposite to those of the thermistors in terms of the change in resistance value relative to the change in temperature may be used as the first and second temperature detectors.

(6) Examples 1 and 2 cite the electrophotographic printer as the image formation apparatus. Nevertheless, the invention is applicable to multifunction printers (MFPs), facsimile machines, copying machines and the like as well.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

a heater;

a fixation unit provided to be heated by the heater and thereby fix an image attached on a print medium onto the print medium;

a first temperature detector provided to detect a temperature of a vicinity of the fixation unit and output a first detection temperature;

a second temperature detector provided to detect a temperature of a place which is different from that of the first temperature detector, and output a second detection temperature;

a medium width detector provided to detect a width of the print medium and output a detected width; and a heat controller configured to obtain a temperature of the fixation unit based on the first and second detection temperatures and to control the temperature of the fixation unit based on the obtained temperature of the fixation unit and a target temperature, wherein under a predetermined condition, the heat controller controls the temperature of the fixation unit by setting the target temperature at a first target temperature, and if a quantity of heat supplied to the fixation unit exceeds one of a first threshold and a second threshold for a heat quantity judgment set based on the detected width while controlling a drive of the heater based on the first target temperature and the temperature of the fixation unit, the heat controller replaces the first target temperature with a second target temperature which is lower than the first target temperature, and continues fixing the image onto the print medium, wherein the first threshold is set by the heat controller when the detected width of the print medium by the medium width detector is a first width and the second threshold is set by the heat controller when the detected width of the print medium by the medium width detector is a second width smaller than the first width.

2. The image formation apparatus according to claim 1, wherein a calorific value is calculated by the heat controller and is a quantity of heat supplied to the fixation unit during a period of time of printing.

3. The image formation apparatus according to claim 2, further comprising a number-of-printed-print-media detector configured to detect the number of printed print media that have been printed continuously since starting the printing, and output the detected number of printed print media, wherein the calorific value is calculated in accordance with the detected number of printed print media.

4. The image formation apparatus according to claim 2, wherein the heat controller includes a timer configured to measure a time length of print duration for which the image formation apparatus has continuously printed the print media since starting the printing, and the calorific value is calculated in accordance with the time length of print duration measured by the timer.

5. The image formation apparatus according to claim 1, wherein the heater is a fixation heater.

6. The image formation apparatus according to claim 1, wherein the fixation unit includes a roller whose heat capacity is smaller than that of a support member that supports the fixation unit.

7. The image formation apparatus according to claim 1, wherein the fixation unit includes a fixation belt whose heat capacity is smaller than that of a support member that supports the fixation unit.

8. The image formation apparatus according to claim 1, wherein if the second detection temperature is lower than a predetermined temperature before the image formation apparatus starts the printing, the heat controller judges that the second detection temperature satisfies the predetermined condition, and sets the target temperature at the first target temperature.

9. The image formation apparatus according to claim 1, wherein the heat controller controls the temperature of the fixation unit such that end portions of the heater are provided with a higher calorific value than a middle portion of the heater.

10. The image formation apparatus according to claim 1, wherein, based on the detected width, an amount of heat needed to be generated by the heater to heat the fixation unit is determined to bring a temperature of the end portions of the heater closer to a temperature of the middle portion of the heater.

11. The image formation apparatus according to claim 10, wherein, when the detected width is determined to have increased from a previously detected width, the amount of heat needed to be generated by the heater to heat the fixation unit to bring the temperature of the end portions of the heater closer to the temperature of the middle portion of the heater is increased.

12. An image formation apparatus comprising:

a heater;

a fixation unit provided to be heated by the heater and thereby fix an image attached on a print medium onto the print medium;

a first temperature detector provided to detect a temperature of a vicinity of the fixation unit and output a first detection temperature;

a second temperature detector provided to detect a temperature of a place which is different from that of the first temperature detector, and output a second detection temperature;

a medium width detector provided to detect a width of the print medium and output a detected width;

a number-of-printed-print-media detector provided to detect the number of printed print media that have been printed continuously since starting the printing, and output a detected number of printed print media; and a heat controller configured to obtain a temperature of the fixation unit based on the first and second detection temperatures and control the temperature of the fixation unit based on the obtained temperature of the fixation unit and a target temperature, wherein under a predetermined condition, the heat controller controls the temperature of the fixation unit by setting the target temperature at a first target temperature, and if the detected number of printed print media exceeds one of a first threshold and a second threshold for a heat quantity judgment set based on the detected width while controlling a drive of the heater based on the first target temperature and the temperature of the fixation unit, the heat controller replaces the first target temperature with a second target temperature which is lower than the first target temperature, and continues fixing the image onto the print medium, wherein the first threshold is set by the heat controller when the detected width of the print medium by the medium width detector is a first width and the second threshold is set by the heat controller when the detected width of the print medium by the medium width detector is a second width smaller than the first width.

13. The image formation apparatus according to claim 12, wherein if the second detection temperature is lower than a predetermined temperature before the image formation apparatus starts the printing, the heat controller judges that the second detection temperature satisfies the predetermined condition, and sets the target temperature at the first target temperature.

14. The image formation apparatus according to claim 12, wherein a calorific value is calculated by the heat controller and is a quantity of heat supplied to the fixation unit during a period of time of printing.

15. The image formation apparatus according to claim 14, further comprising a number-of-printed-print-media detector configured to detect the number of printed print media that have been printed continuously since starting the printing, and output the detected number of printed print media, wherein the calorific value is calculated in accordance with the detected number of printed print media.

16. The image formation apparatus according to claim 14, wherein the heat controller includes a timer configured to measure a time length of print duration for which the image formation apparatus has continuously printed the print media since starting the printing, and the calorific value is calculated in accordance with the time length of print duration measured by the timer.

17. The image formation apparatus according to claim 12, wherein the heater is a fixation heater.

18. The image formation apparatus according to claim 12, wherein the fixation unit includes a roller whose heat capacity is smaller than that of a support member that supports the fixation unit.

19. The image formation apparatus according to claim 12, wherein the fixation unit includes a fixation belt whose heat capacity is smaller than that of a support member that supports the fixation unit.

20. The image formation apparatus according to claim 12, wherein the heat controller controls the temperature of the fixation unit such that end portions of the heater are provided with a higher calorific value than a middle portion of the heater.

21. The image formation apparatus according to claim 12, wherein, based on the detected width, an amount of heat needed to be generated by the heater to heat the fixation unit is determined to bring a temperature of the end portions of the heater closer to a temperature of the middle portion of the heater.

22. The image formation apparatus according to claim 21, wherein, when the detected width is determined to have increased from a previously detected width, the amount of heat needed to be generated by the heater to heat the fixation unit to bring the temperature of the end portions of the heater closer to the temperature of the middle portion of the heater is increased.

* * * * *